US005615556A

United States Patent [19]

Honda et al.

[11] Patent Number: 5,615,556

[45] Date of Patent: Apr. 1, 1997

[54] FREE-PISTON VUILLEUMIER HEAT PUMP

[75] Inventors: Tetsuya Honda; Kazuhiko Kawajiri, both of Hyogo, Japan

[73] Assignee: Mitsubishi Denki Kabushiki Kaisha, Tokyo, Japan

[21] Appl. No.: 463,498

[22] Filed: Jun. 5, 1995

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 4,969,333 | 11/1990 | Osawa et al. | 62/6 |
| 5,435,140 | 7/1995 | Ishino et al. | 62/6 |
| 5,483,802 | 1/1996 | Karawajiri et al. | 62/6 |

FOREIGN PATENT DOCUMENTS 2-4174 9/1990 Japan .

OTHER PUBLICATIONS

H. Carlsen "Development of a Gas Fired Vuilleumier Heat Pump For Residential Heating" IEEE 1989.

*Primary Examiner*—Ronald C. Capossela
*Attorney, Agent, or Firm*—Wolf, Greenfield & Sacks, P.C.

[57] ABSTRACT

A free-piston Vuilleumier heat pump in which displacers having a spring-operated resonance system, controls the heating energy and cooling energy outputs by controlling strokes of a hot displacer and a cold displacer. The control of the displacer strokes is performed by controlling the working gas temperature in a hot working space. Furthermore, the control of the displacer strokes may be performed by controlling a motor output while keeping the operation frequency of the motor mounted for at least one of the hot displacer and the cold displacer, in the vicinity of a resonance frequency which is determined by the driving system of the hot displacer and the cold displacer. Even in the free-piston Vuilleumier heat pump using the spring-operated resonance system thus constituted for reciprocating motion, a fine output adjustment is carried out in accordance with heating and cooling loads and therefore it is possible to control to change the working gas temperature in the high-temperature section, thus obtaining a stable operating condition and a high coefficient of performance (COP).

7 Claims, 18 Drawing Sheets

FREE-PISTON VUILLEUMIER HEAT PUMP

BACKGROUND OF THE INVENTION

1.Field of the Invention

The present invention relates to a free-piston Vuilleumier heat pump applicable to an air-conditioning system for the refrigeration or the heating and cooling of buildings and, more particularly, to the output control thereof.

2.Description of the Prior Art

FIGS. 15 and 16 are views showing the constitution of a prior art Vuilleumier heat pump and a simplified flow of output control processing disclosed in Japanese Patent Laid-Open No. Hei 2-4174. In FIG. 15, reference numeral 2 denotes a hot cylinder, in which a hot displacer 3, which separates a hot working space 2*a* hermetically filled with a high-pressure working gas such as helium from a moderate temperature working space 2*b* on the hot cylinder side, reciprocates. The hot working space 2*a* and the moderate temperature working space 2*b* on the hot cylinder side are connected through a hot heat exchanger 6, a regenerator 8 on the hot cylinder side, and a moderate temperature heat exchanger 9 on the hot cylinder side. The hot heat exchanger 6 is heated at the outer wall thereof by a heating device 36. Reference numeral 7 refers to a fin for accelerating heat exchange. Reference numeral 4 denotes a cold cylinder, in which a cold displacer 5, which separates a cold working space 4*a* from a moderate temperature working space 4*b* on the cold cylinder side, reciprocates. The cold working space 4*a* and the moderate temperature working space 4*b* on the cold cylinder side are connected through a cold heat exchanger 12, a regenerator 11 on the cold cylinder side, and a cold heat exchanger 10 on the cold cylinder side. Furthermore, the moderate temperature working space 2*b* on the hot cylinder side and the moderate temperature space 4*b* on the cold cylinder side are connected by a connecting pipe 14; on the outside wall of the cold heat exchanger 12 section, there is flowing a fluid which is circulated by the cooling water pump 38 between the heat exchangers 17 and 40 for cooling; and on the outside walls of the moderate temperature heat exchanger 10 on the cold cylinder side and the moderate temperature heat exchanger 9 on the hot cylinder side, a fluid which is circulated by a heating water pump 37 between the heat exchangers 15 and 39 for heating is flowing. The heat exchanger 39 for heating and a heat exchanger 40 for cooling are disposed outdoors, and the heat exchanger 15 for heating and a heat exchanger 17 for cooling are disposed in a room, thus constituting an indoor unit 41. Reference numeral 13 designates a tube; 16, a heating water pipe line; 18, a cooling water pipe line; and 42 to 45, three-way valves.

To the hot displacer 3 is fixedly connected a hot displacer rod 21; and to the cold displacer 5 is fixedly connected a cold displacer rod 22. The hot displacer rod 21 is mounted through a moderate temperature working space partition wall 26 on the hot cylinder side which has an appropriate sealing mechanism, and the cold displacer rod 22 is mounted through a moderate temperature working space partition wall 27 which has an appropriate sealing mechanism, and the rods are connected to a crank mechanism including members 19, 20 and 23 in the crank case 25. To a rotating shaft 24 of the crank mechanism are connected a driving device 28 and a braking device 29.

Next, operation will be explained by referring to a flowchart in FIG. 16. On starting, when a heat transfer medium such as water is circulated by the heating water pump 37 for the moderate temperature heat exchanger 9 on the hot cylinder side and the moderate temperature heat exchanger 10 on the cold cylinder side and by the cooling water pump 38 for the cold heat exchanger 12, for the purpose of thereby heating a part of the hot cylinder 2 and the surface of the hot heat exchanger 6 by use of the heating device 36 (Step ST2), and the driving device 28 is operated to reciprocate the hot displacer 3 and cold displacer 5 while maintaining a fixed phase difference (Step ST1). Then, the temperature of the working gas in the hot working space 2*a* rises and the temperature of the working gas in the moderate temperature working space 2*b* on the hot cylinder side rises a little higher than the temperature of a heat transfer medium which is circulated by the heating water pump 37, producing in the working gas a pressure change nearly proportional to the temperature difference between the working gas in the hot working space 2*a* and that in the moderate temperature working space 2*b* on the hot cylinder side.

Since the moderate temperature working space 2*b* on the hot cylinder side and the moderate temperature working space 4*b* on the cold cylinder side are connected by the connecting pipe 14, the pressure change of the working gas thus produced is transmitted, as it is, to the cold cylinder 4 side, and accordingly the temperature of the working gas in the moderate temperature working space 4*b* on the cold cylinder side is raised, by the work of compression of the working gas, nearly to the same temperature as the working gas in the moderate temperature working space 2*b* on the hot cylinder side. The temperature of the working gas in the cold working space 4*a* is decreased, by the work of expansion of the working gas, lower than that in the moderate temperature working space 4*b* on the cold cylinder side.

When the above-mentioned condition is obtained, the heat transfer medium circulated by the heating water pump 37 is heated by the working gas in the moderate temperature heat exchanger 9 on the hot cylinder side and the moderate temperature heat exchanger 10 on the cold cylinder side, thereby increasing in temperature to obtain the heat for heating a building. In the meantime, the heat transfer medium which is circulated by the cooling water pump 38 is cooled by the working gas in the cold heat exchanger 12, thus obtaining the heat for cooling a building.

A sufficient temperature rise of the working gas in the hot working space 2*a* produces a sufficient pressure change of the working gas; thus a pressure difference between the working gas on the cylinder side and the working gas on the crankcase 25 side acts on the hot displacer rod 21 and cold displacer rod 22, to generate a driving work, thus obtaining a self sustaining which does not require the driving device 28 at an operation frequency at which the driving work and a friction loss arising primarily in the mechanical section are balanced.

When an output necessary for a self-sustaining condition or more is required or when an output for the self-sustaining condition or less is required in accordance with a heating or cooling load, the following control is effected by a controller 32. First, information on the heating water temperature and cooling water temperature detected (Steps ST3 and ST5) by temperature detecting devices 30 and 31 for the heating effect transfer medium and the cooling effect transfer medium are compared with preset temperatures (Steps ST4 and ST6) in order to calculate a required speed (operation frequency) (Step ST7). Subsequently, the required speed and a self-sustaining operation speed are compared by use of a comparing device 33 (Step ST8). When the required speed is greater than the self-sustaining operation speed, a backup control of the driving device 28 is effected by means of a backup device 34 (Step ST9); and reversely when the required speed is less than the self-sustaining operation speed, a brake control of the braking device 29 is carried out by means of the brake control device 35 (Step ST10).

In the above-described prior art Vuilleumier heat pump, since the strokes of the displacers 3 and 5 in the cylinder per rotation of the crankshaft and a phase difference of the two displacers 3 and 5 are kept constant at all times, it is possible to control a heating or cooling energy output by changing the number of strokes of the displacers 3 and 5 per unit time, that is, the number of revolutions of the crankshaft, by controlling the driving device 28 or the braking device 29 mounted on the crankshaft end.

Next, a prior art free-piston Vuilleumier heat pump proposed by the applicant et al. in Japanese Patent Laid-Open No. 5-231735 that uses springs to constitute a resonance system shown in FIG. 17 will be explained. In FIG. 17, wherein parts corresponding to those in FIG. 15 are designated by the same reference numerals, and will not be described. In FIG. 17, reference numeral 51 refers to a coil spring on the hot cylinder side with one end thereof secured on a spring case 50 on the hot cylinder side, and the other end secured on the hot displacer rod 21 and a motor coil 52*a* on the hot cylinder side. Around the motor coil 52*a* on the hot cylinder side are disposed a magnet 52*b* on the hot cylinder side and a yoke 52*c* on the hot cylinder side as a magnetic circuit, thereby constituting a direct-acting motor 52.

Similarly, reference numeral 54 denotes a coil spring on the cold cylinder side, with one end thereof secured on a spring a spring case 53 on the cold cylinder side and the other end secured on a cold displacer rod 22 and a motor coil 55*a* on the cold cylinder side. Around the motor coil 55*a* on the cold cylinder side are disposed a magnet 55*b* on the cold cylinder side and a yoke 55*c* on the cold cylinder side as a magnetic circuit, thereby constituting a double-acting motor 55.

Next, operation of the heat pump will be explained. In the prior art example shown in FIG. 15, the hot displacer 3 and cold displacer 5, connected by the crank mechanisms 19, 20 and 23, are so constituted as to always maintain a constant phase difference and a stroke, while the hot displacer 3 and cold displacer 5 in the prior art example shown in FIG. 17 are constituted of resonance systems including independent springs 51 and 54, and they differ from the displacers in FIG. 15 in the respect that the phase difference and stroke of them vary according to operating conditions; however, their modes of operation on the cooling cycle are the same.

When the hot heat exchanger 6 is heated by the heating device 36, and one or both of the motor 52 on the hot cylinder side and the motor 55 on the cold cylinder side are started to reciprocate the hot displacer 3 and cold displacer 5, there occurs a pressure change with the movement of the working gas in the working space in the similar manner as the prior art example shown in FIG. 15. At this time, because of the presence of a pressure difference between the working gas within the working space and the working gas within the spring case 50 on the hot cylinder side, a driving force which is proportional to the sectional area of the hot displacer rod 21 acts on the hot displacer 3. The hot displacer 3 is driven by the resonance system utilizing this driving force and the restoring force of the coil spring 51 on the hot cylinder side; in a steady state, the reciprocating operation is repeated at an operation frequency, which is determined by both the resonance frequency of the driving system of the hot displacer 3 and the resonance frequency of the driving system of the cold displacer 5, even when the motor is stopped. At this time, with the movement of the working gas, the fluid resistance occurring in the hot heat exchanger 6, the regenerator 8 on the hot cylinder side and the moderate temperature heat exchanger 9 on the hot cylinder side and the sliding resistance by the sealing member (not shown) acts on the hot displacer 3 as a damping resistance which cancels the driving force, thereby determining the stroke.

In the meantime, the cold displacer 5 is similarly driven by the resonance system inclusive of the driving force proportional to the sectional area of the cold displacer rod 22 and the restoring force of the coil spring 54 on the cold cylinder side; the fluid resistance occurring at the moderate temperature heat exchanger 10 on the cold cylinder side, the regenerator 11 on the cold cylinder side, and the cold heat exchanger 12 and the sliding resistance caused by the sealing member (not shown) act as the damping resistance, thereby determining the stroke.

In the free-piston Vuilleumier heat pump, the optimum phase difference of the reciprocating motion between the hot displacer 3 and the cold displacer 5 is about 90 degrees because of the characteristics of gas cycle; therefore, in the case of the heat pump which is driven by use of a crankshaft as in the prior art example shown in FIG. 15, the crank angle has been pre-adjusted so as to provide the aforementioned phase difference, and also in the case of the free-piston heat pump as in the prior art example shown in FIG. 17, the spring constant and the weight of a movable part have been adjusted.

The free-piston Vuilleumier heat pump, being of the aforesaid constitution, has the following problem when the heating energy or cooling energy output is adjusted. That is, in the prior art Vuilleumier heat pump shown in Fig. 15, the two displacers 3 and 5 continue constant operation with a fixed phase difference even when the shaft speed is changed by means of the crank mechanism that has been pre-adjusted. FIG. 18 illustrates results of the heating energy and cooling energy outputs, the phase difference between the two displacers 3 and 5, and a coefficient of performance (COP) in the case of the free-piston type that the inventor et al. have acquired by experiments when the operation frequency corresponding to the crankshaft speed is changed. As these results indicate, the phase difference of the two displacers 3 and 5 varies in accordance with the change of the operation frequency; the heating energy and cooling energy outputs and the coefficient of performance at the resonance frequency (around 17.5 Hz in this example) which is determined by the driving system become a maximum; and if the operation frequency is deviated from the resonance frequency, the heating energy and cooling energy outputs and the coefficient of performance will be considerably deteriorated. Furthermore because the output characteristics vary at the resonance frequency, the output control will become complicated, making it necessary to change over the control between a higher required operation frequency than the resonance frequency and a lower required operation frequency than the resonance frequency and consequently resulting in difficult keeping of a stabilized condition of control.

SUMMARY OF THE INVENTION

It is, therefore, an object of the present invention to provide a free-piston Vuilleumier heat pump which is capable of realizing a stable and proper operating condition in either of the heating and cooling cycles without seriously deteriorating the coefficient of performance.

According to the present invention, the free-piston Vuilleumier heat pump is provided with a hot displacer which has a resonance system using a spring in a hot cylinder to thereby make a reciprocating motion, and a hot working space and a moderate temperature working space on a hot cylinder side which are separated by the hot displacer, and is provided with a cold displacer which has a resonance system using a spring inside a cold cylinder to thereby make a reciprocating motion, and a cold working space and a moderate temperature working space on a cold cylinder side which are separated by the cold displacer. The hot working space and the moderate temperature working space on the hot cylinder side is connected through a hot heat exchanger, a regenerator on the hot cylinder side, and a moderate temperature heat exchanger on the hot cylinder side, and the cold working space and the moderate temperature working space on the cold cylinder side is connected through a moderate temperature heat exchanger, a regenerator on the cold cylinder side, and a moderate temperature heat exchanger on the cold cylinder side. Therefore, the moderate temperature working space on the hot cylinder side is connected to the moderate temperature working space on the cold cylinder side. The heat is ejected from the moderate temperature heat exchanger on the hot cylinder side and the moderate temperature heat exchanger on the cold cylinder side and the cooling effect is obtained from the cold heat exchanger by heating the working gas in the hot working space. In this heat pump, the heating energy and cooling energy outputs are controlled through the control of the strokes of the hot and cold displacers.

In operation, since the heating energy and cooling energy outputs are controlled through the control of strokes of the hot and cold displacers, the free-piston Vuilleumier heat pump can change the strokes of the hot and cold displacers without giving almost any change to the operation frequency. Therefore, also in the free-piston Vuilleumier heat pump which operates by utilizing the resonance system of a spring, it is possible to easily and stably increase and decrease the heating energy and cooling energy outputs; even when the load has changed, the heat pump is able to operate constantly in the vicinity of the resonance frequency, thus maintaining a high coefficient of performance.

According to the preferred embodiment, the free-piston Vuilleumier heat pump controls the strokes of the hot and cold displacers by controlling the temperature of the working gas in the hot working space. Furthermore, the free-piston Vuilleumier heat pump preferably controls the temperature of the working gas in the hot working space by controlling the quantity of heat for heating the working gas in the hot working space. Therefore, it is possible to increase and decrease the heating energy and cooling energy outputs with ease and stability.

Further according to the preferred embodiment, since the free-piston Vuilleumier heat pump is equipped with a motor which gives a driving force directly to at least one of the hot and cold displacers, the strokes of, the hot and cold displacers are controlled by controlling the output of the motor while keeping the operation frequency of the motor near the resonance frequency which is determined by the driving system of the hot and cold displacers. Consequently, the heating energy and cooling energy outputs can be increased and decreased easily and with stability, thereby enabling to constantly obtain a steady operating condition and a high coefficient of performance in the vicinity of the resonance frequency.

Furthermore, according to the preferred embodiment, the free-piston Vuilleumier heat pump is provided with a temperature detecting mechanism for detecting the temperature of at least one of the heating load side and the cooling load side, to thereby control the heating energy and cooling energy outputs according to a temperature information which can be acquired from the temperature detecting mechanism. Accordingly, it is possible to supply proper heat to the load at all times.

Furthermore, according to the preferred embodiment, the free-piston Vuilleumier heat pump is equipped with a detecting mechanism for detecting the position of at least a part of the displacers in the reciprocating motion of the hot and cold displacers, so that it may control the heating energy and cooling energy outputs in accordance with an information including a temperature information fed from the temperature detecting mechanism plus a positional information given from this detecting mechanism. Therefore, it is possible to perform the stroke control of the displacers while avoiding collisions of each displacer against the cylinder at the top and bottom ends of its stroke at the time of a rise of the working gas temperature in the hot working space and an interruption of operation by a lowering of the working gas temperature in the hot working space, thus constantly obtaining a stabilized operating condition and preventing burning resulting from breakage or stoppage of the displacer caused by the collision.

And furthermore, the free-piston Vuilleumier heat pump is provided with a vibration detecting mechanism in a stationary part of either cylinder, and controls the heating and cooling energy outputs in accordance with an information given by the vibration detecting mechanism added to the temperature information obtained from the temperature detecting mechanism. Therefore, it is possible to obtain operation stability without continuation of the collisions of the top and bottom ends of each displacer against each cylinder at the time of a rise of the working gas temperature in the hot working space, and to prevent breakage likely to be caused by collision.

All of the foregoing and still further objects and advantages of the present invention will become apparent from the following study of the preferred embodiments, taken in connection with the accompanying drawings.

DETAILED DESCRIPTION OF THE PREFERRED EMBODIMENTS

The cooling effect produced in the gas cycle is given by the equation (1) by subtracting a heat loss from a product of a changing space pressure integrated by a space volume per cycle and the operation frequency.

$$Q_c = \oint P_c \cdot dV_c \times F - Q_{LC} \quad (1)$$

wherein $Q_c$: cooling effect produced $P_c$: pressure in cold working space 4*a*

*V*c: the volume of the cold working space 4*a*

*F*: operation frequency $Q_{LC}$: heat loss

Figure 18:
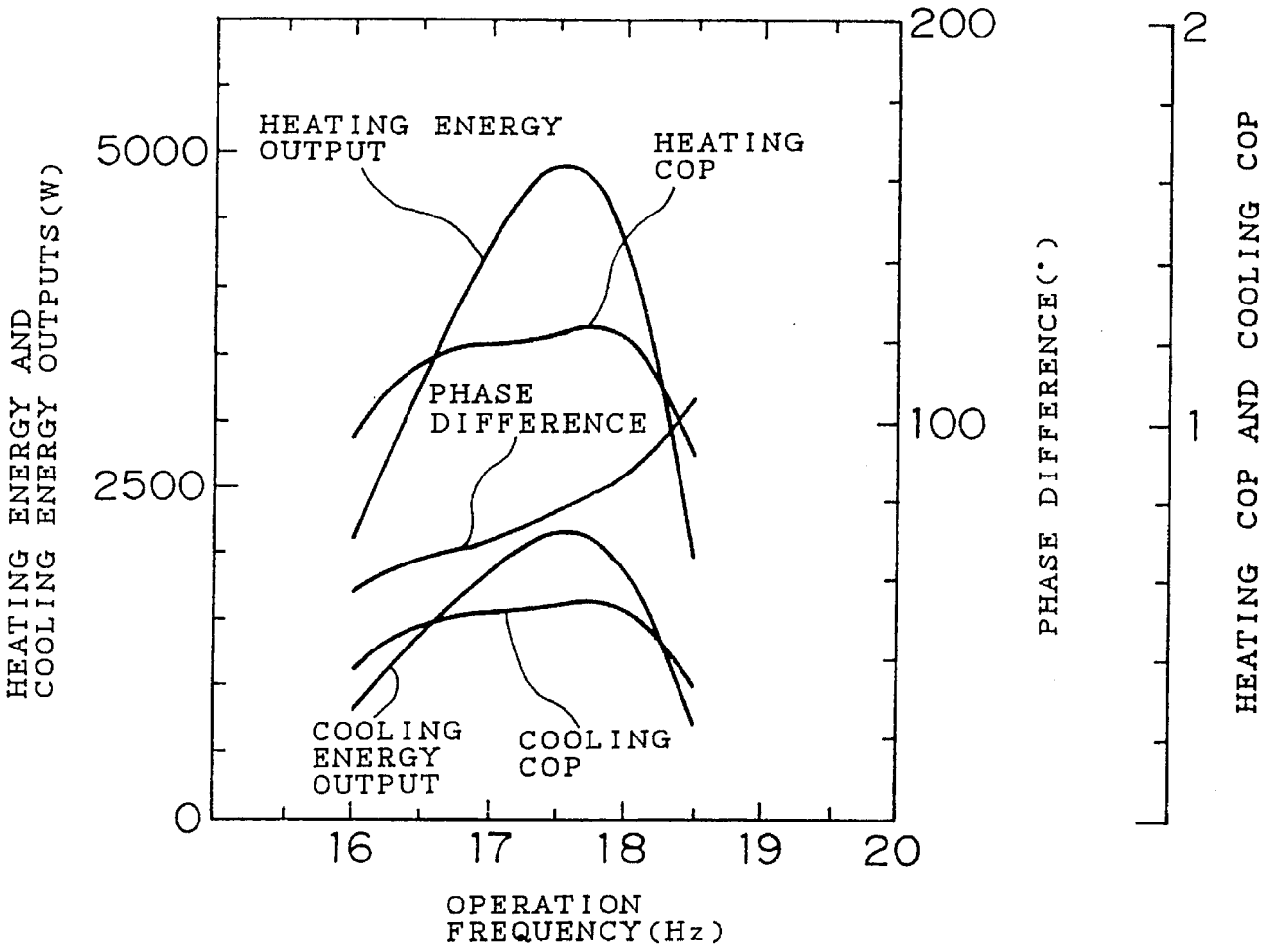
FIG. 18 is a characteristic curve showing various characteristics in relation to the operation frequency of the free-piston Vuilleumier heat pump shown in FIG. 17.

In the meantime, the amount of heat generated can be similarly given by the equation (2).

$$Q_H = (\oint P_{MH} \cdot dV_{MH} + P_{mc} \cdot dV_{MC}) \times F - Q_{LH} \quad (2)$$

wherein $Q_H$: amount of heat generated $P_{MH}$: pressure in moderate temperature working space 2*b* on hot cylinder side $P_{MC}$: pressure in moderate temperature working space 2*b* on cold cylinder side $V_{MH}$: the volume of moderate temperature working space 4*b* on hot cylinder side $V_{MC}$: the volume of moderate temperature working space 4*b* on cold cylinder side $Q_{LH}$: heat loss These equations (1) and (2) show that, in order to change the amount of heat produced for heating and cooling, it is necessary to change a space pressure, a volume, or the operation frequency. The operation frequency changes the motors on the hot cylinder side and on the cold cylinder side. However, as is clear from a result of measurements of an actual heat pump illustrated in FIG. 18, the heating energy and cooling energy outputs reach a maximum at an ideal operation frequency (around 17.5 Hz in this example) which is determined from a relationship of the resonance frequency of the driving system of both displacers. Even when a slight change in frequency is made from this state, the heating and cooling coefficient of performance suddenly decreases. With the change of the operation frequency as described above, there also occurs a serious change in characteristics, resulting in a difficulty in keeping a maximum value of output characteristics and in a failure to maintain a high coefficient of performance.

To change the resonance frequency itself of the driving system for the purpose of changing the operation frequency while keeping a high coefficient of performance it is necessary to change the resonance frequency of each driving system given by the equation (3). To make this change, the weight of the movable part or the spring constant must be changed. However, these factors can not be changed during operation; that is, they can not be control elements.

$$F_0 = \frac{1}{2\pi} \cdot \sqrt{\frac{K}{M}} \quad (3)$$

wherein $F_0$ :resonance frequency

K :spring constant

M :weight of moving part

Figure 1:
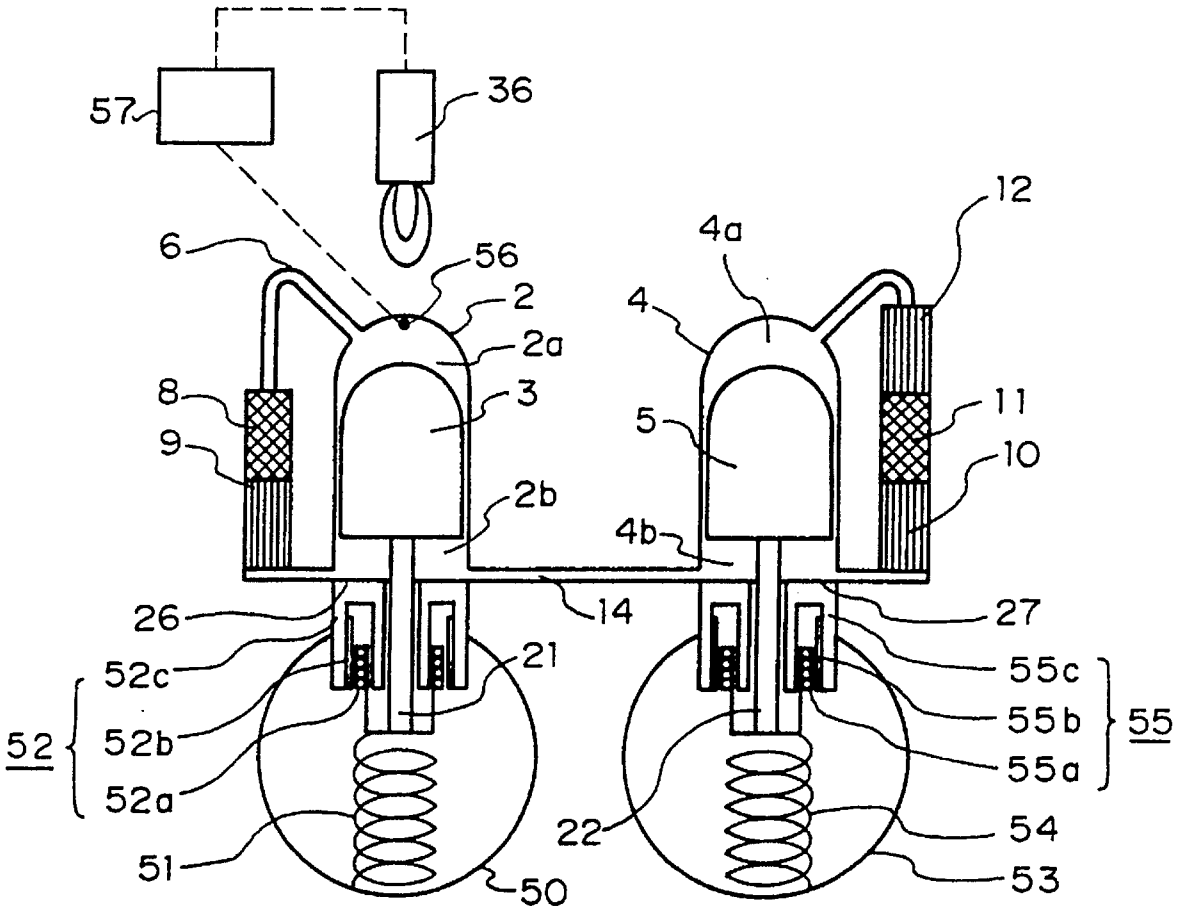
FIG. 1 is a sectional view showing the constitution of a free-piston Vuilleumier heat pump according to one embodiment of the present invention.

FIG. 1 is a sectional view showing the constitution of one embodiment of the free-piston Vuilleumier heat pump according to the present invention. The volumetric change of the spaces 2*a*, 2*b*, 4*a* and 4*b* denoted by $dV_c$, $dV_{MH}$, and $dV_{MC}$ in the equations (1) and (2) can be control elements that can be changed during operation. This can be realized by changing the strokes of the hot displacer 3 and the cold displacer 5, thereby enabling the change of the quantity of heat for heating and refrigeration effect produced.

The displacer strokes are determined by balancing driving forces produced in proportion to the sectional area of the hot displacer rod 21 and the cold displacer rod 22 due to the pressure differences between the spaces 2*a* and 2*b* and the spring case 50 on the hot cylinder side and between the spaces 4*a* and 4*b* and the spring case 53 on the cold cylinder side, damping forces by damping resistances, and driving forces by the motors, respectively. The damping force developed by the damping resistance is an element determined by the construction of the equipment and therefore can not freely be changed during operation. The former driving forces, on the other hand, are easily changeable by changing the pressure differences acting on the hot displacer rod 21 and the cold displacer rod 22 which are always constant during operation. Since the pressure differences in this case depend on the range of pressure fluctuation in each of the spaces 2*a*, 2*b*, 4*a* and 4*b* and the spring cases 50 and 53, changing the range of pressure fluctuation enables the change of stroke. The pressure fluctuations in these spaces result from a change in the total mean temperature of the working gas caused by variation in the volume ratio of the hot working space 2*a*, moderate temperature working space 2*b* on the hot cylinder side, moderate temperature working space 4*b* on the cold cylinder side, and cold working space 4*a* which changes with the movement of the displacers 3 and 5; the range of pressure fluctuation depends on the temperature of the working gas in each space. That is, when the temperature differences of the working gas in the four spaces are little, the ranges of pressure fluctuations are small; and when the temperature differences are great, the ranges of pressure fluctuations grow larger. In one space other than the hot working space 2*a*, the working gas temperature is governed by heating and cooling loads; however, the working gas temperature in the hot working space 2*a* to which a temperature condition can be given by combustion is relatively easily changeable.

Figure 2:
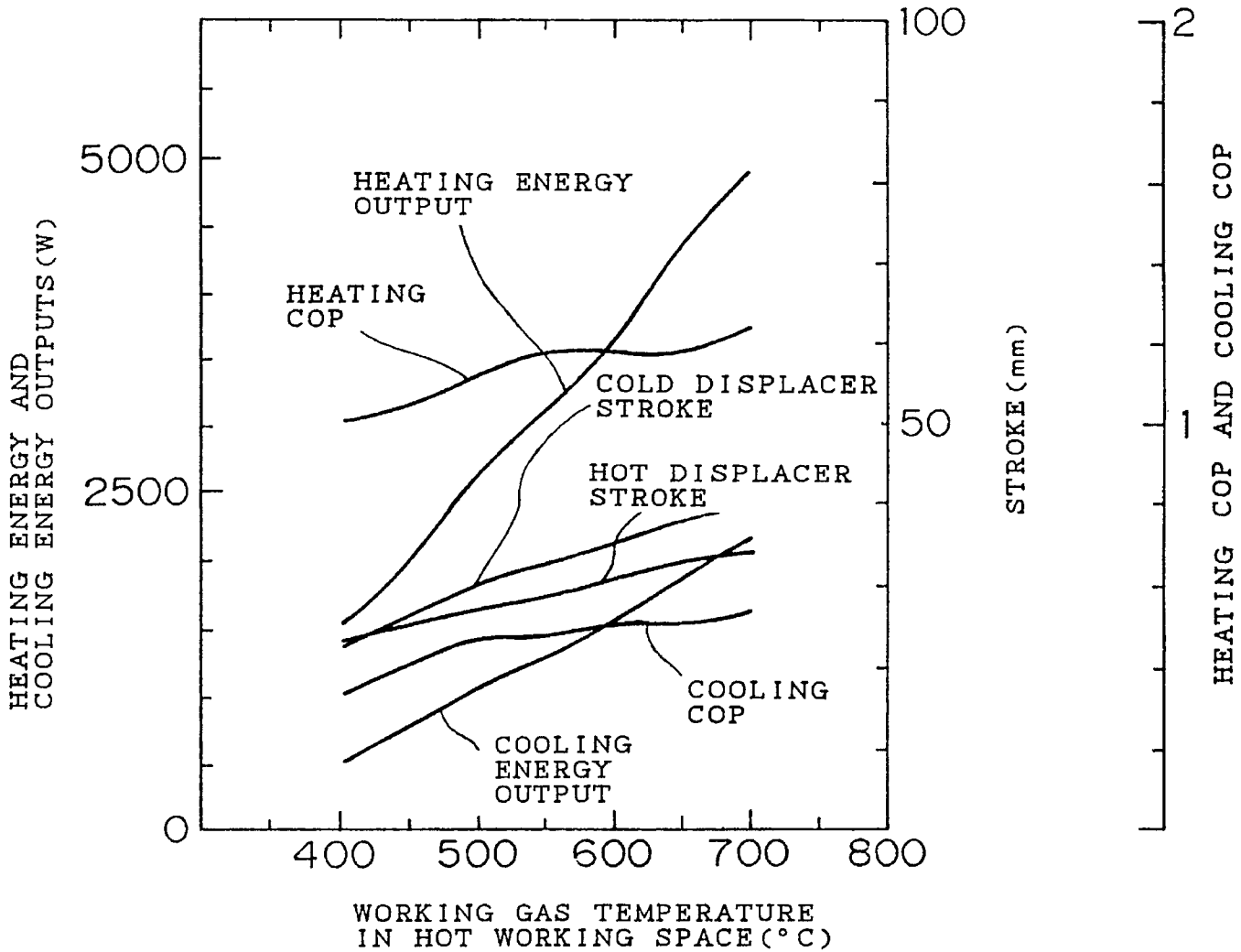
FIG. 2 is a characteristic curve showing various characteristics in relation to the temperature of a working gas in a hot working space of the free-piston Vuilleumier heat pump.

FIG. 2 shows one example of a result of the heating energy and cooling energy outputs produced when the working gas temperature in the hot working space is changed, the strokes of the hot displacer 3 and the cold displacer 5, and the heating and cooling operation efficiencies. From this result, it is understood that the strokes of the displacers 3 and 5 and the heating energy and cooling energy outputs vary in proportion to the change of the working gas temperature in the hot working space 2*a*, and further that the heating and cooling operation efficiencies vary little.

Figure 17:
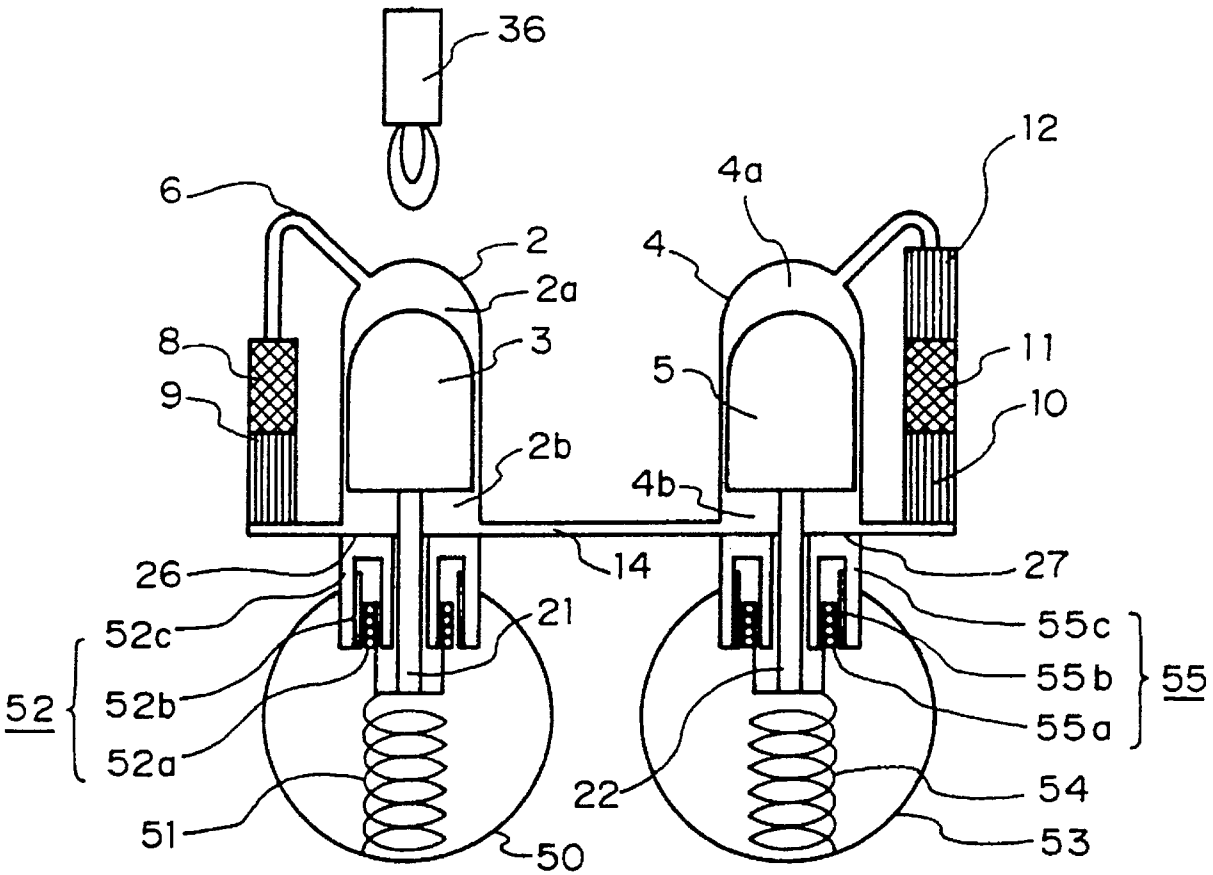
FIG. 17 (PRIOR ART)
FIG. 17 is a sectional view showing the constitution of a prior art free-piston Vuilleumier heat pump.

Therefore, in the free-piston Vuilleumier heat pump of the prior art example illustrated in FIG. 17, it is possible to change the heating energy and cooling energy outputs by changing the strokes of the hot displacer 3 and cold displacer 5, and also to easily change the strokes of these displacers by changing the working gas temperature in the hot working space 2*a*.

As illustrated in FIG. 1, therefore, the free-piston Vuilleumier heat pump of the present embodiment is so constituted as to detect the working gas temperature in the hot working space 2*a*. In FIG. 1, reference numeral 56 denotes a temperature detecting element such as a thermocouple so mounted as to detect the working gas temperature in the hot working space 2*a*. Reference numeral 57 denotes a heating control device for controlling the amount of working gas to be heated by the heating device 36 by conducting the optimum operation on the basis of a temperature information obtained from the temperature detecting element 56 plus a target temperature control information previously inputted. Other components are the same as those illustrated in FIG. 17 and therefore will not be described.

Next, operation will be explained. According to the free-piston Vuilleumier heat pump of the present embodiment, the heating control device 57 serves to control the quantity of heat supplied to the working gas by use of the heating device 36 in order to change the heating energy and cooling energy outputs, that is, in order to change the strokes of the hot displacer 3 and cold displacer 5 by changing the working gas temperature in the hot working space 2*a*. As a method for obtaining a stable control condition, it is preferable to control the quantity of working gas by use of the heating device 36 by acquiring a temperature information from the temperature detecting element 56 which can directly detect the working gas temperature in the hot working space 2*a*, and then performing an appropriate control operation, such as a PID control, in order to keep the working gas temperature in the hot working space 2*a* up to the target control temperature preset according to operating conditions in the heating control device 57. According to this method, since the quantity of heat supplied to the working gas is changed properly in accordance with the temperature information obtained from the temperature detecting element 56 even when the target control temperature of the working gas in the hot working space 2*a* is changed in accordance with operating conditions, the working gas temperature in the hot working space 2*a* can be controlled properly and with stability, thereby enabling to increase and decrease the heating energy and cooling energy outputs easily and stably.

Figure 3:
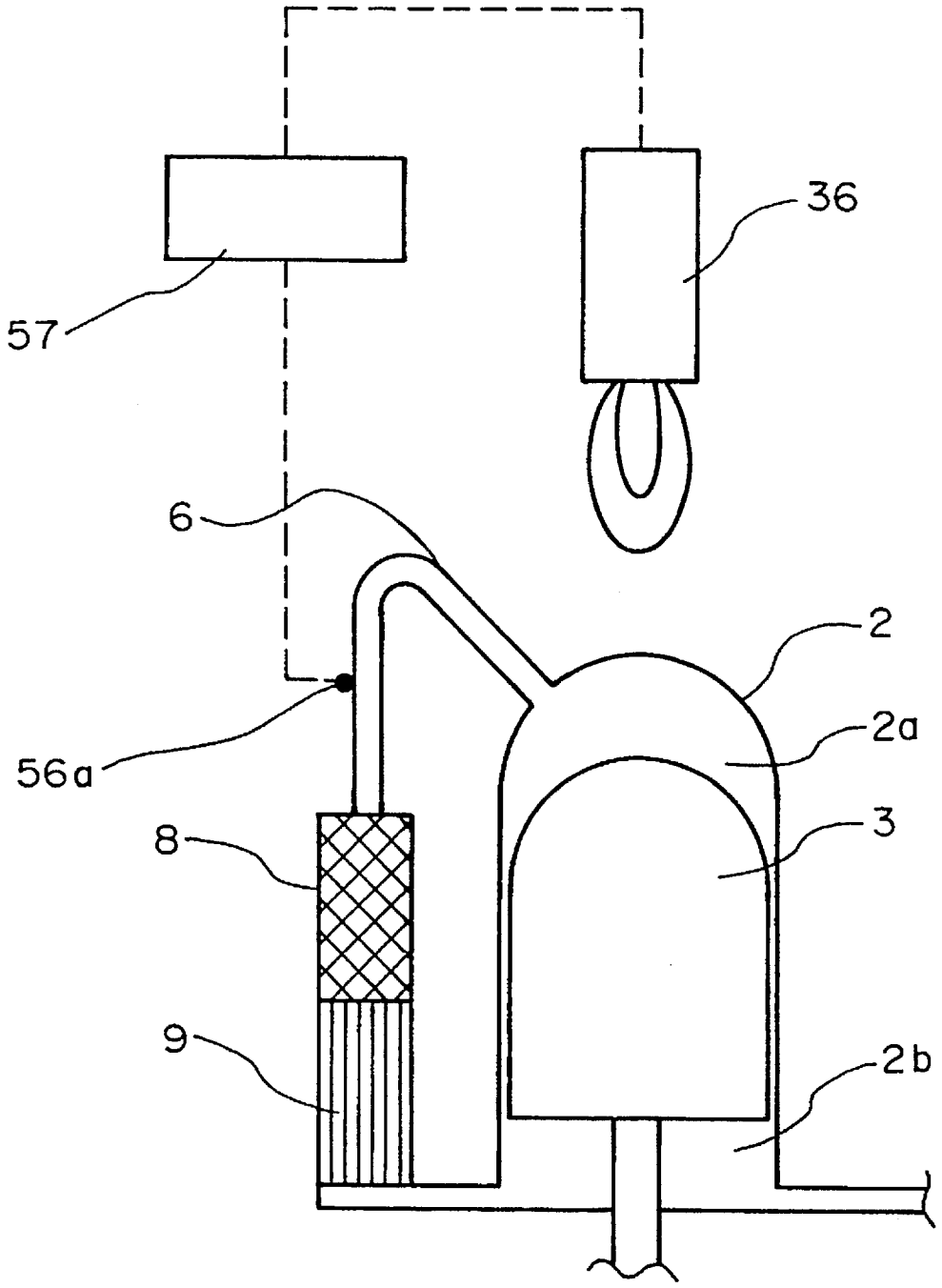
FIG. 3 is a sectional view showing the constitution of a major portion of one modification of the above-described embodiment of the free-piston Vuilleumier heat pump of Fig. 1.
Figure 4:
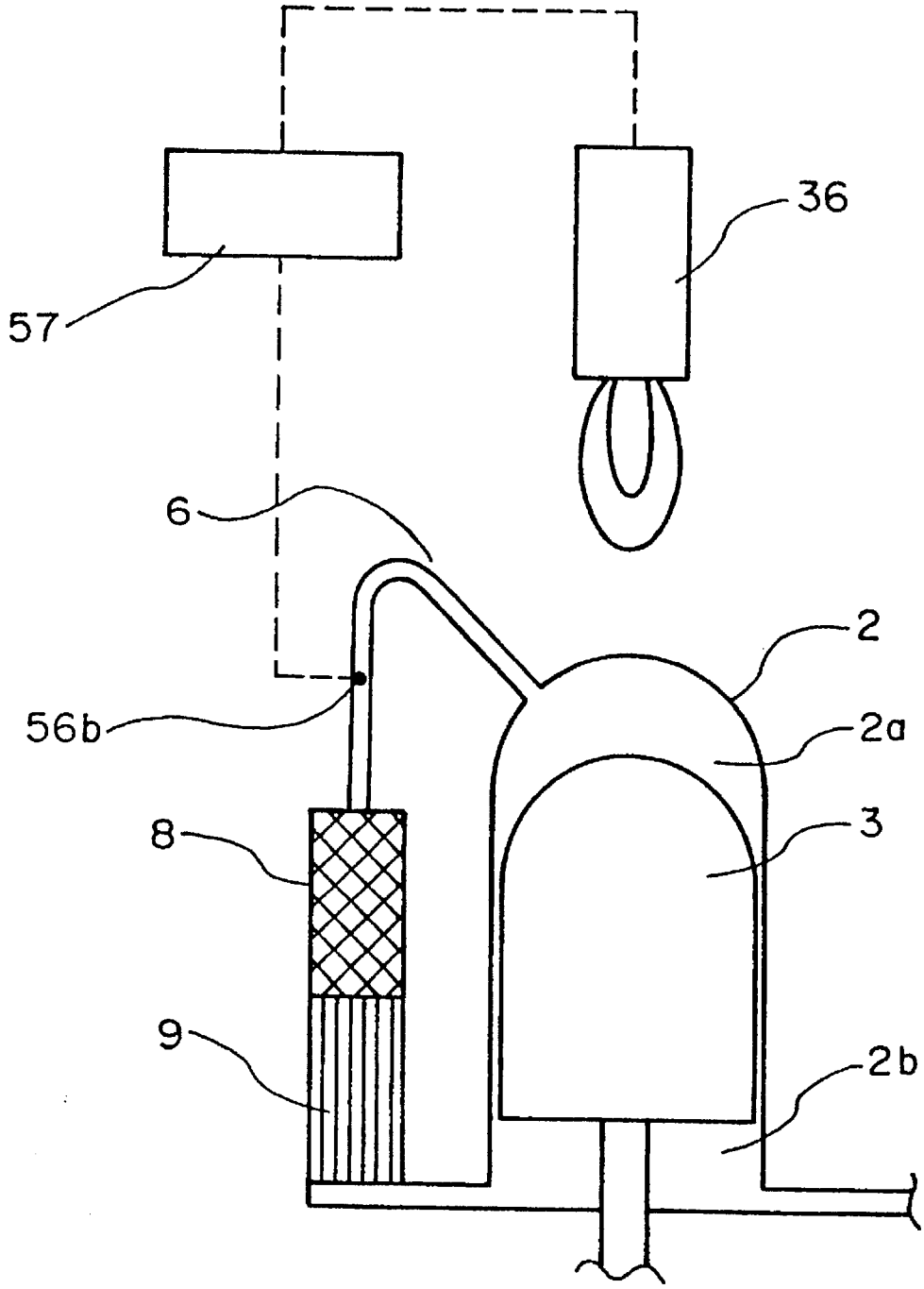
FIG. 4 is a sectional view showing the constitution of a major portion of one modification of the above-described embodiment of the free-piston Vuilleumier heat pump of Fig. 1.
Figure 5:
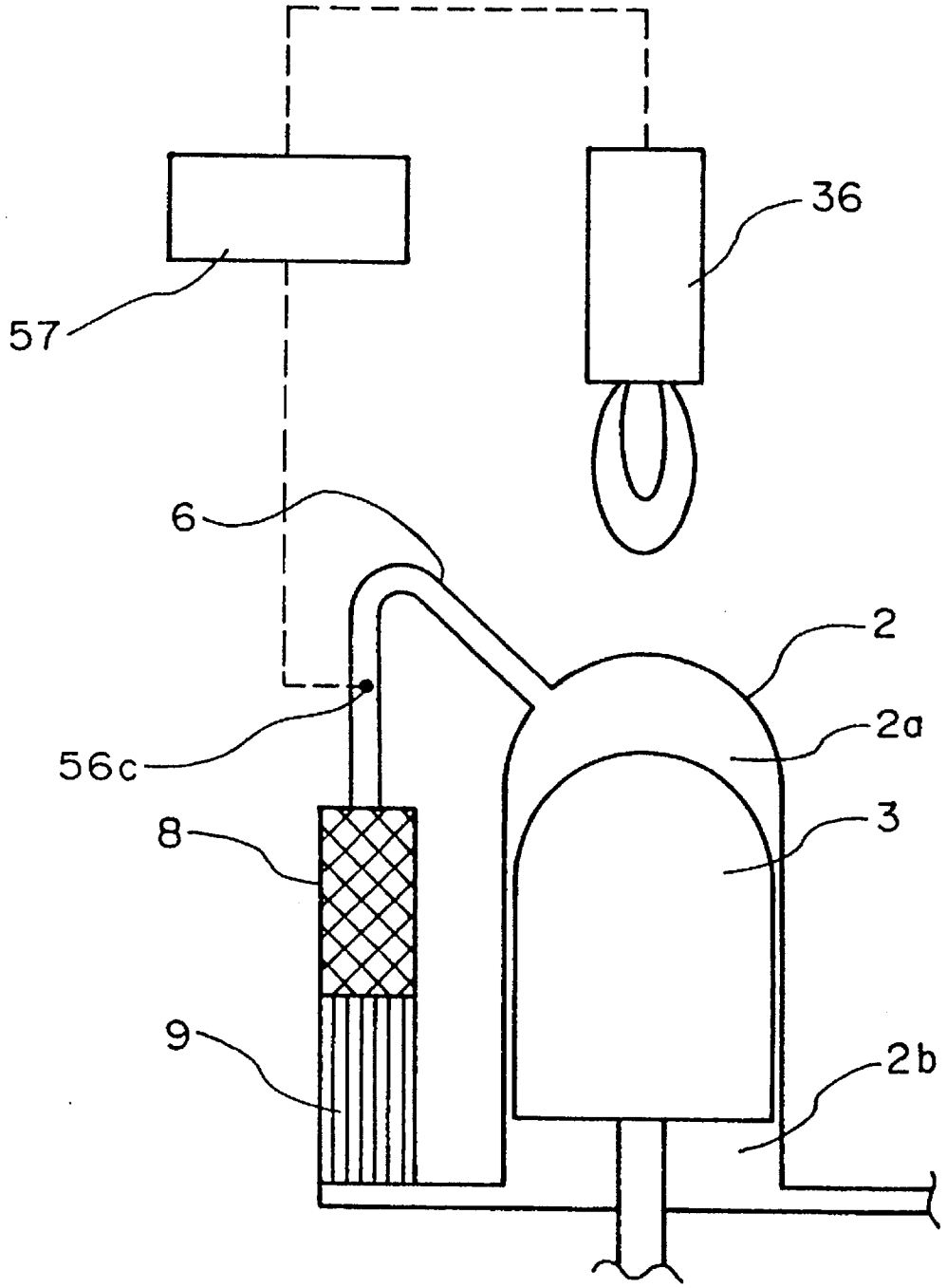
FIG. 5 is a sectional view showing the constitution of a major portion of one modification of the above-described embodiment of the free-piston Vuilleumier heat pump of Fig. 1.
Figure 6:
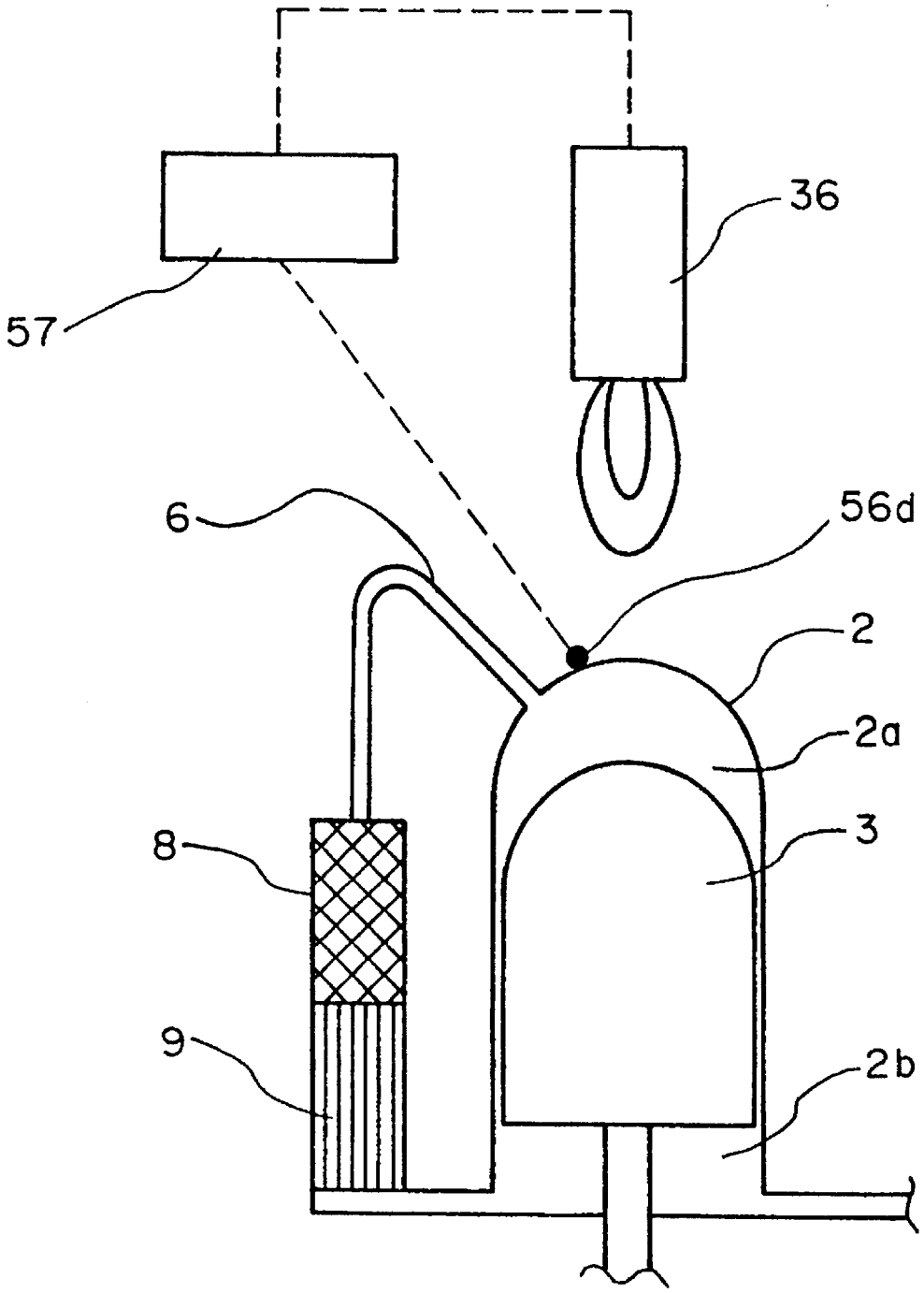
FIG. 6 is a sectional view showing the constitution of a major portion of one modification of the above-described embodiment of the free-piston Vuilleumier heat pump of Fig. 1.
Figure 7:
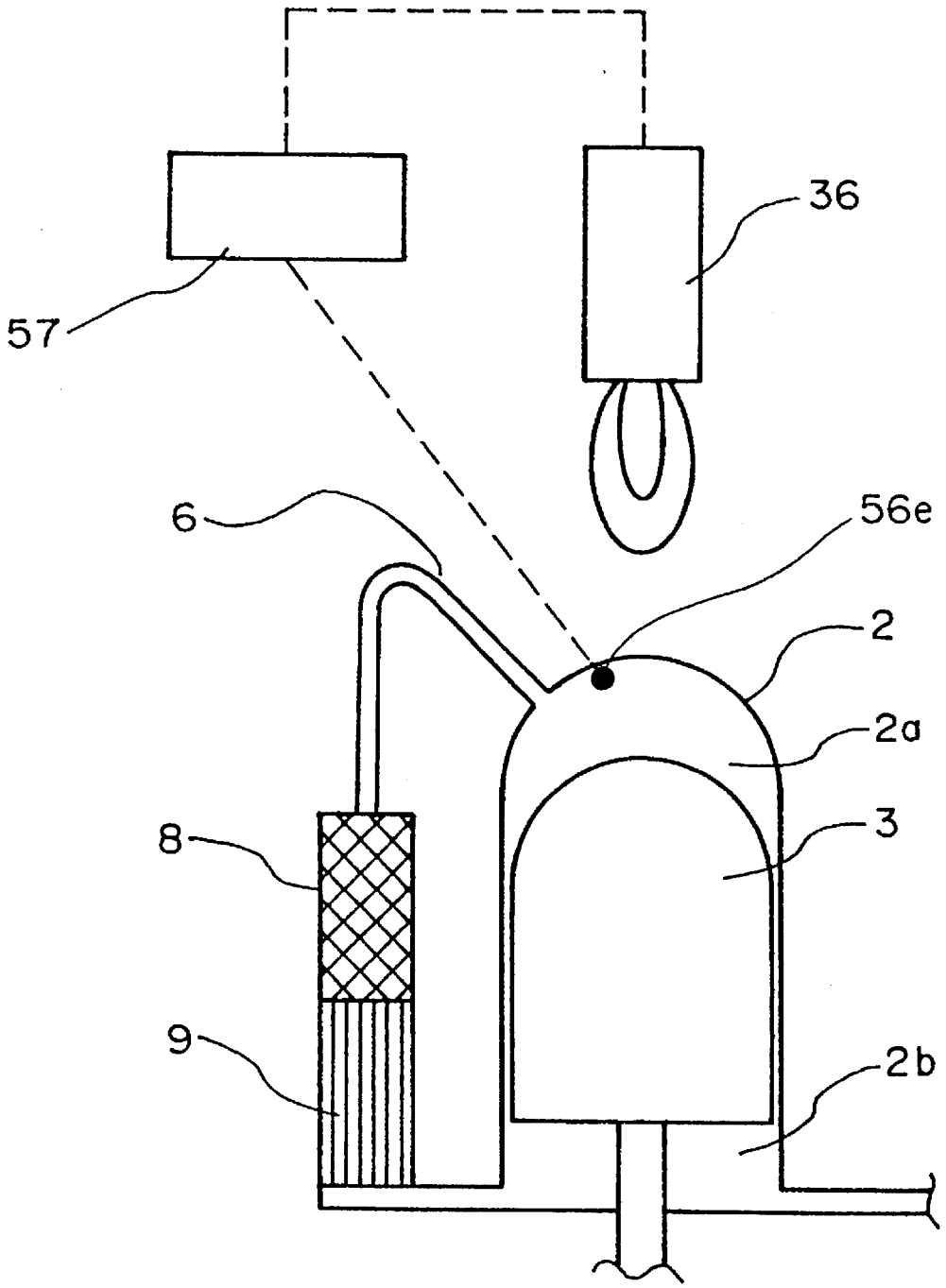
FIG. 7 is a sectional view showing the constitution of a major portion of one modification of the above-described embodiment of the free-piston Vuilleumier heat pump of Fig. 1.

It should be noticed that the present invention is not limited to the free-piston Vuilleumier heat pump of the present embodiment provided with the temperature detecting element 56, such as the thermocouple, which is so mounted as to detect the working gas temperature in the hot working space 2*a*, and many modifications are possible. For example, the same advantage as the embodiment described above can be obtained because it is possible to indirectly detect the temperature of the working gas in the hot working space 2*a* by use of a temperature detecting element 56*a* so provided as to detect the outside wall temperature of the hot heat exchanger shown in FIG. 3, a temperature detecting element 56*b* so provided as to detect the inside wall temperature of the hot heat exchanger 6 shown in Fig. 4, a temperature detecting element 56*c* so provided as to detect the temperature of the working gas in the hot heat exchanger shown in FIG. 5, a temperature detecting element 56*d* so provided as to detect the outside wall temperature in the vicinity of the hot working space 2*a* of the hot cylinder 2 shown in FIG. 6, and a temperature detecting element 56*e* so provided as to detect the outside and inside wall temperatures in the vicinity of the hot working space 2*a* of the hot cylinder 2 shown in FIG. 7. In these drawings is shown only the hot cylinder 2; the cold cylinder 4 is not described.

The free-piston Vuilleumier heat pump is so constituted that the strokes of the hot displacer 3 and the cold displacer 5 are changed by changing the working gas temperature in the hot working space, consequently changing the heating energy and cooling energy outputs, but the present invention is not limited thereto and the strokes may be changed by changing the outputs of the driving motors 52 and 55.

Figure 8:
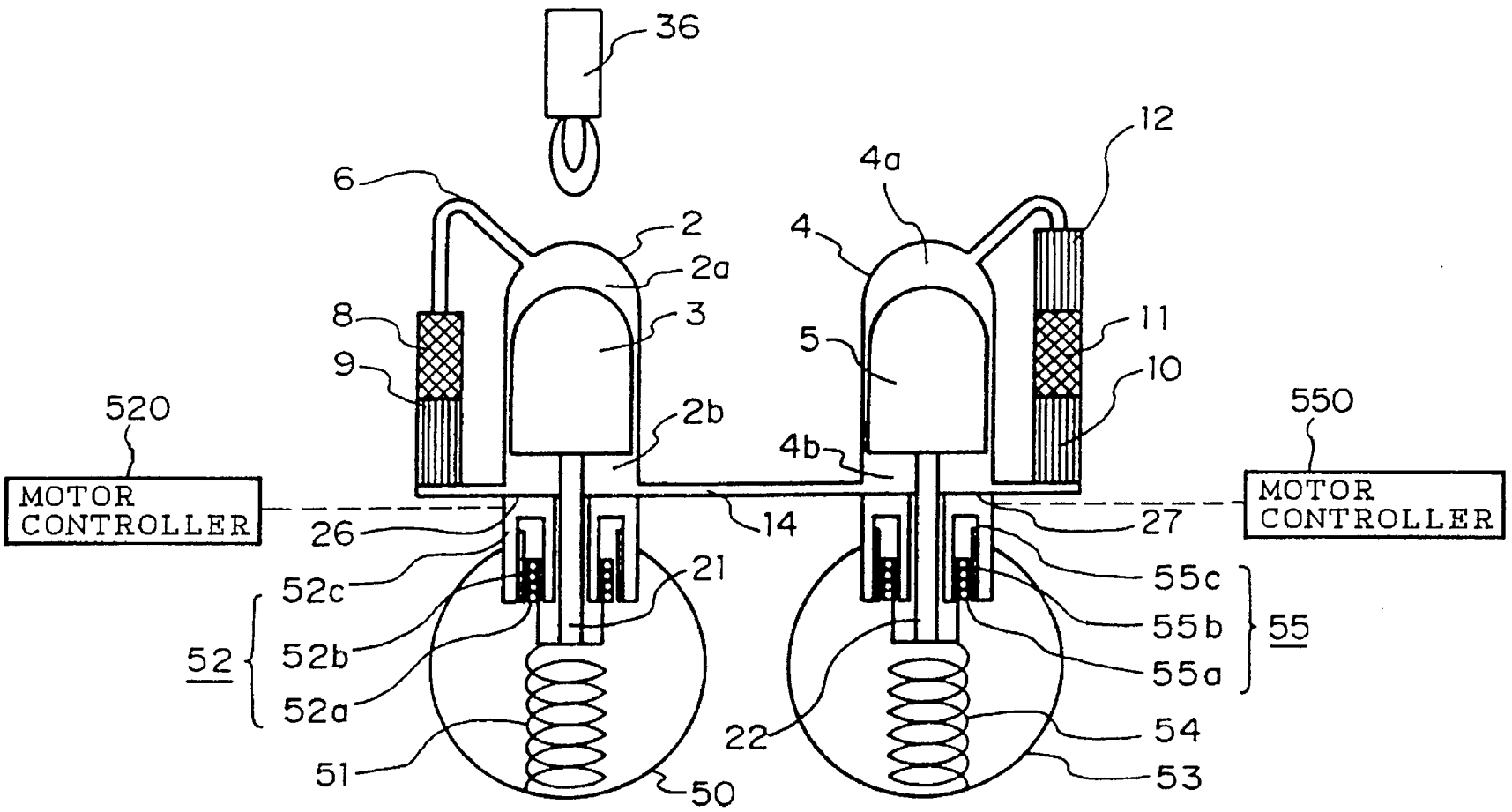
FIG. 8 is a sectional view showing the constitution of a free-piston Vuilleumier heat pump according to another embodiment of the present invention.

FIG. 8 is a sectional view showing the constitution of a free-piston Vuilleumier heat pump according to one embodiment of the present embodiment. As previously stated, the strokes of the hot displacer 3 and the cold displacer 5 are determined by a relationship between the driving forces and the damping resistances; and the driving forces can be not only produced by pressure differences acting on the rods 21 and 22 but given by changing the outputs of the driving motors 52 and 55. The driving motor control devices 520 and 550 control the outputs of the driving motors 52 and 55 respectively. The driving forces of both of the driving motors 52 and 55 may be changed, but even when the driving force of either one driving motor is changed, the stroke of the displacer connected to the driving motor changes, resulting in a change in the range of working gas pressure fluctuation and accordingly in a change in the pressure difference acting on the rod of the other displacer and in a change in the stroke of the other displacer. Consequently, the displacer stroke can be changed by changing the output of at least one of the driving motors 52 and 55 by either one of the driving motor control devices 520 and 550 at a frequency near the resonance frequency of the driving system, and the heating energy and cooling energy outputs can be changed with ease.

Figure 9:
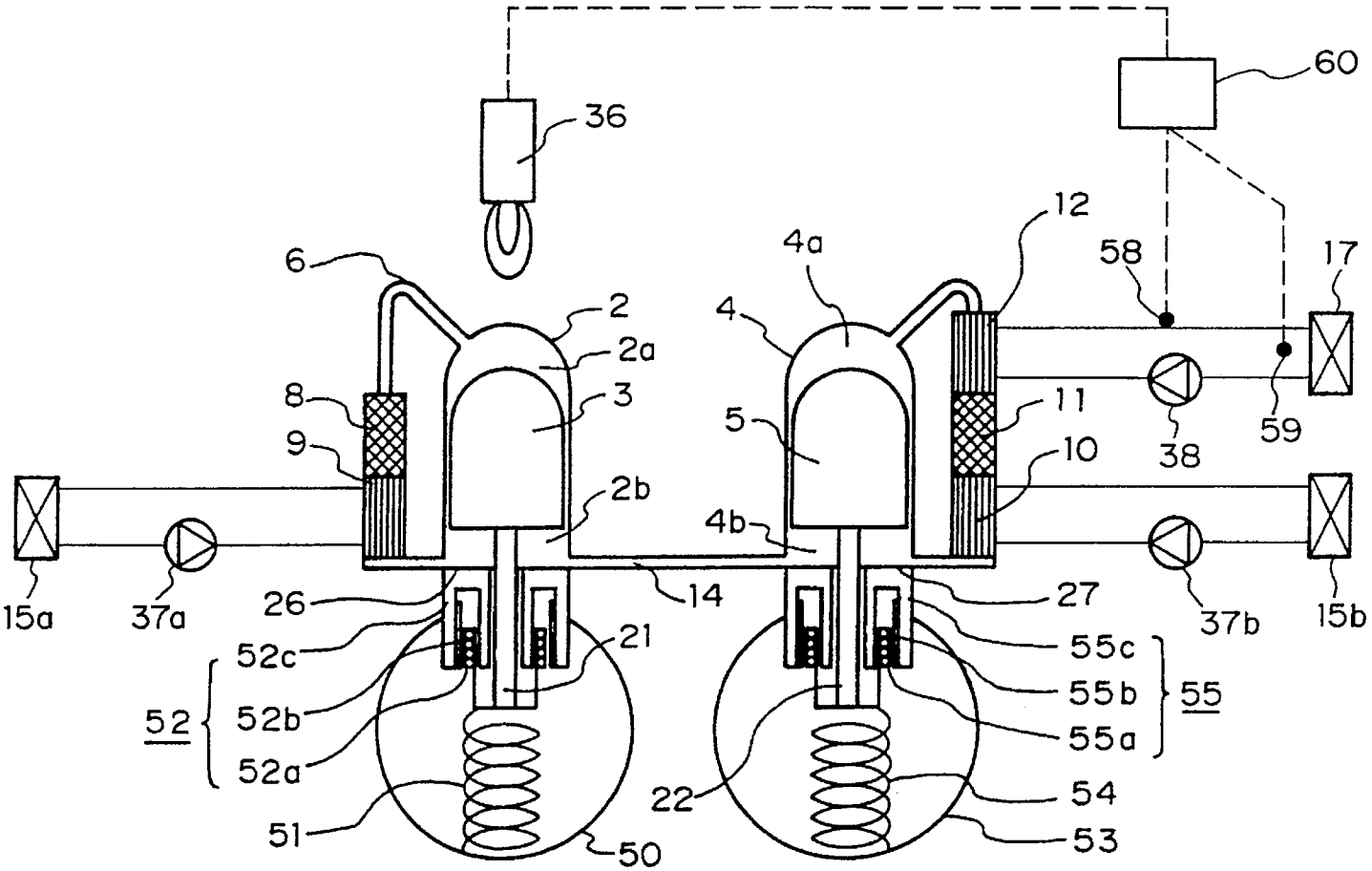
FIG. 9 is a sectional view showing the constitution of a free-piston Vuilleumier heat pump according another embodiment of to the present invention.

FIG. 9 is a sectional view showing the constitution of a free-piston Vuilleumier heat pump according to another embodiment of the present invention. In this drawing, reference numeral 58 refers to a temperature detecting element, such as a thermocouple, so mounted as to detect the temperature of a heat transfer medium such as water; 59 is a temperature detecting element such as a thermocouple which is mounted on the room air inlet side of the heat exchanger 17 for cooling and can detect the room temperature; and 60 denotes a control device which determines the target control temperature of the working gas in the hot working space 2*a* in accordance with an air-conditioning load, thereby controlling the quantity of heat supplied to the working gas by use of the heating device 36.

Next, operation will be explained. When the free-piston Vuilleumier heat pump is operated at a required room temperature, it is necessary to change the heating energy or cooling energy output in accordance with the increase or decrease of the room air-conditioning load. The free-piston Vuilleumier heat pump of the present embodiment directly and indirectly detects a representative temperature in a room (air-conditioned space) by means of the temperature detecting element 58 or 59, and carries out a proper control operation such as the PID control according to a relationship with a set room temperature previously set by means of the control device 60, thus calculating the target control temperature of the working gas in the hot working space 2*a*. The cooling energy output can be controlled in accordance with the air-conditioning load by controlling the quantity of heat supplied to the working gas by use of the heating device 36 according to a result of this calculation, thereby enabling accurate and stable cooling air conditioning to keep a room at the preset room temperature.

Figure 10:
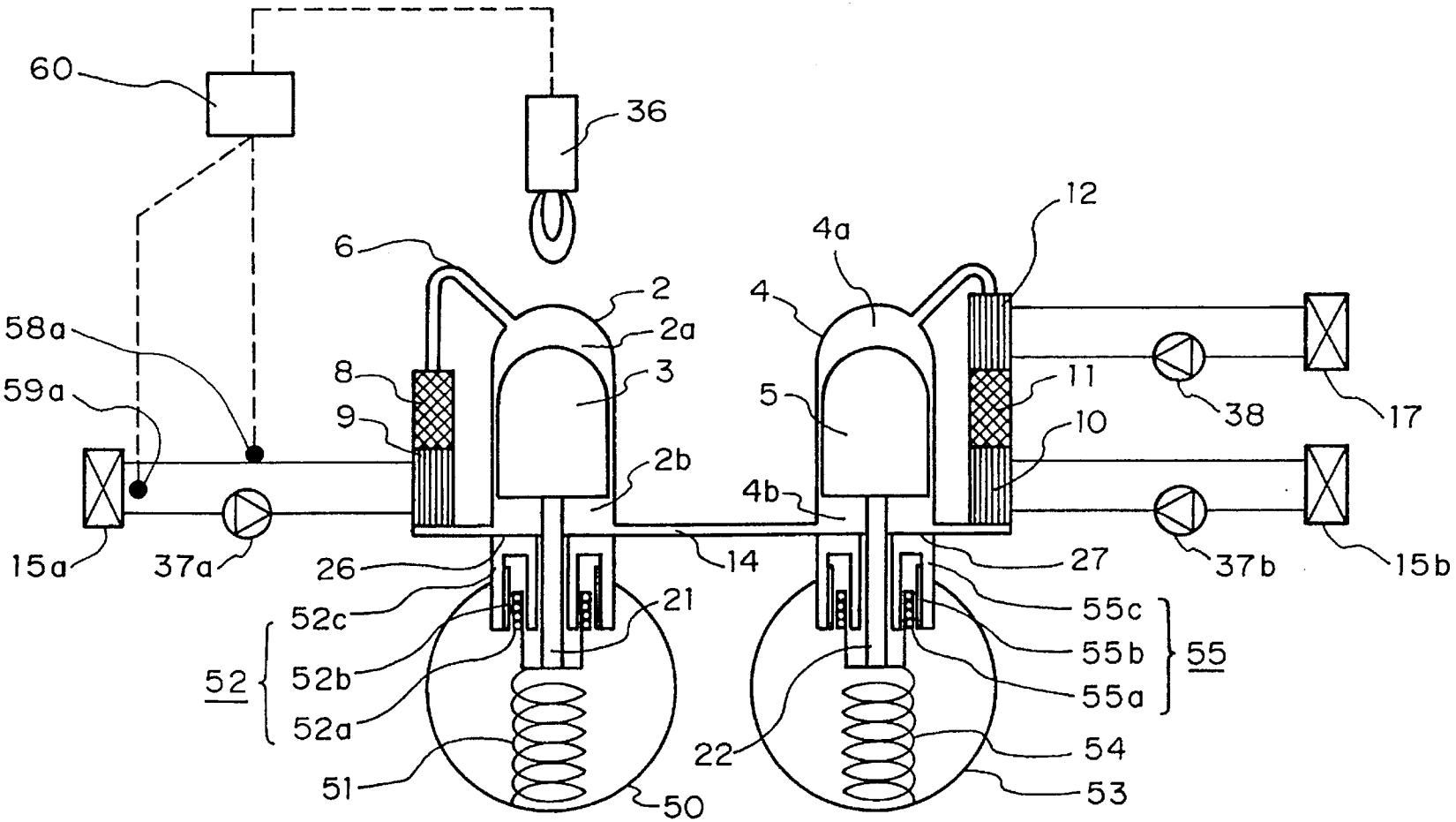
FIG. 10 is a sectional view showing the constitution of a major portion of one modification of the above-described embodiment of the free-piston Vuilleumier heat pump of Fig. 8.
Figure 11:
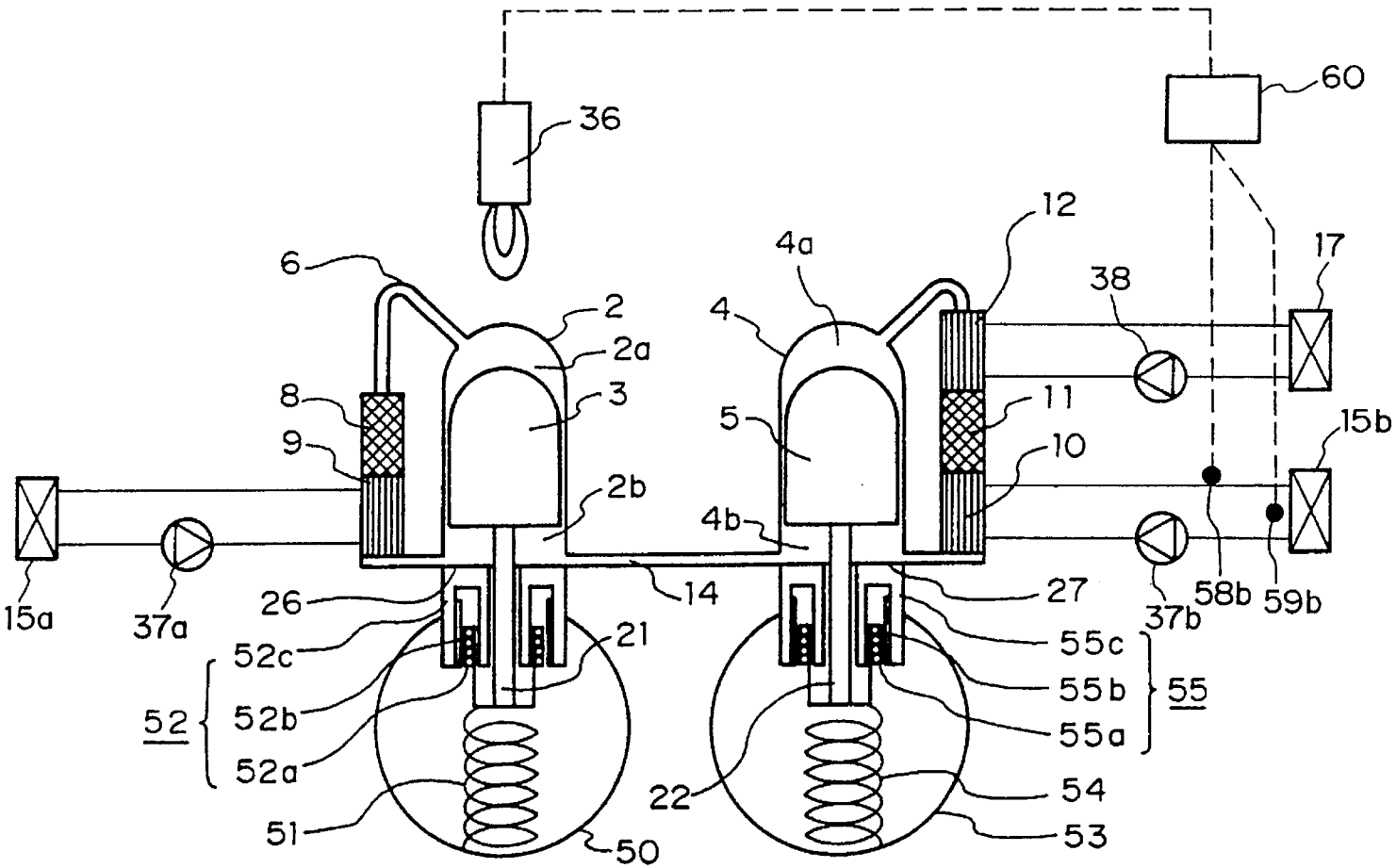
FIG. 11 is a sectional view showing the constitution of a major portion one modification of the above-described embodiment of the free-piston Vuilleumier heat pump of Fig. 8.

As a modification the control operation may be effected to control the heating device 36 on the basis of the temperature information which are given by the temperature detecting elements 58*a* and 58*b* such as thermocouples so mounted as to detect the temperature of the heat transfer medium such as warm water in FIGS. 10 and 11 and by the temperature detecting elements 59*a* and 59*b* such as thermocouples which are mounted on the room air inlet side of the hot heat exchanger to detect the room temperature. In this case, the heating energy output can be controlled to enable exact and stable air conditioning to keep a room at the preset room temperature even during heating operation.

In the present embodiment, the heating or cooling control to be conducted by controlling the amount of working gas to be heated, on the basis of the temperature information has been explained. It is possible to control the strokes of the displacers 3 and 5 even when the outputs of the driving motors 52 and 55 with the frequency being kept near the resonance frequency of the driving system are controlled in accordance with temperature information by use of the driving motor control device shown in FIG. 8, and consequently the heating or cooling energy output is similarly changeable in accordance with the air-conditioning load.

Figure 12:
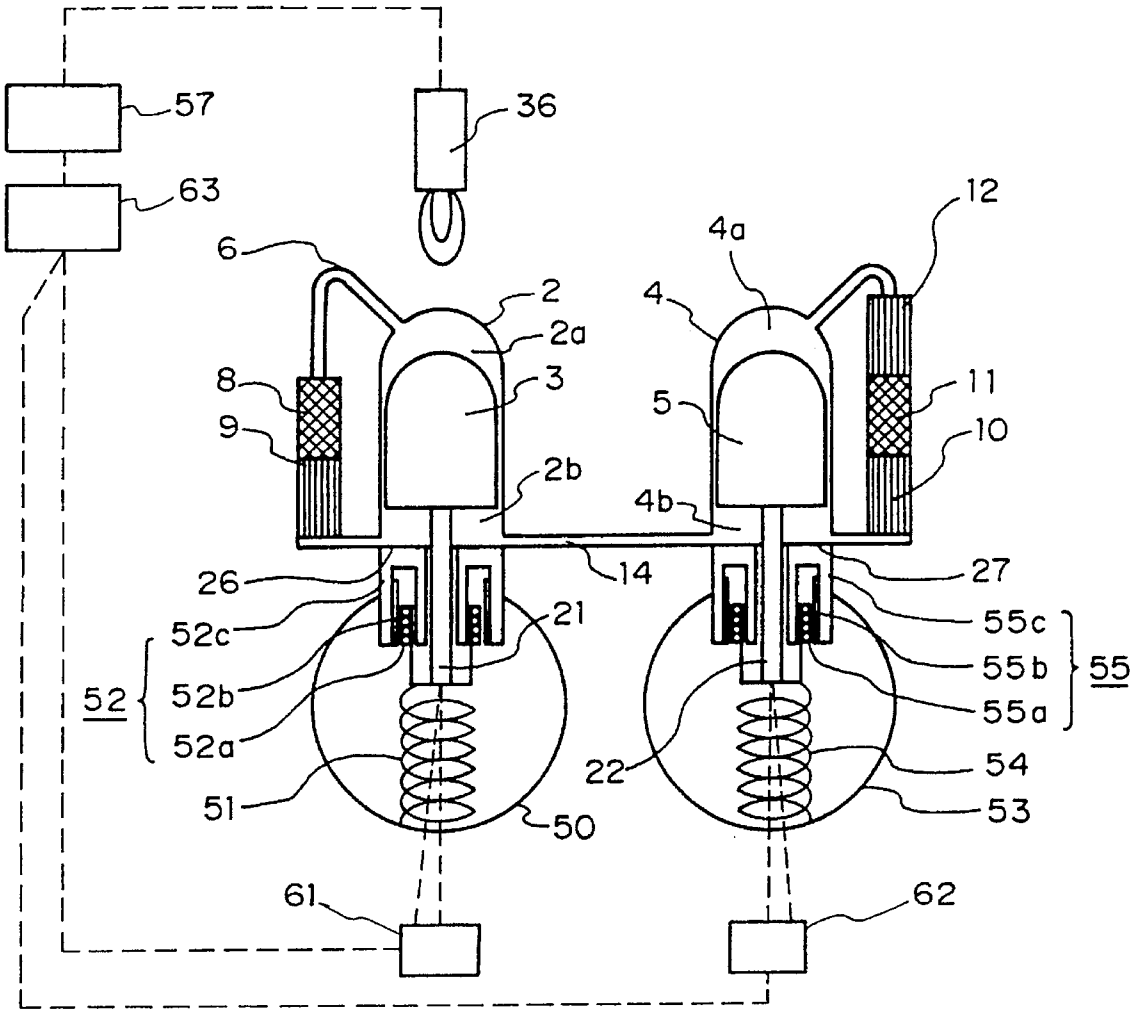
FIG. 12 is a sectional view showing the constitution of a free-piston Vuilleumier heat pump according another embodiment of to the present invention.

FIG. 12 is a sectional view showing the constitution of a free-piston Vuilleumier heat pump according to another embodiment of the present invention. In this drawing, reference numeral 61 denotes a displacement sensor on the hot cylinder side such as a laser-type displacement sensor or an eddy current-type displacement sensor which is capable of detecting the position of the hot displacer 3; 62 refers to a displacement sensor on the cold cylinder side similarly capable of detecting the position of the cold displacer 5; and 63 represents an arithmetic circuit for correcting the target control temperature of the working gas in the hot working space 2*a* in accordance with the displacement of each displacer.

Next, operation will be explained. When the strokes of the hot displacer 3 and cold displacer 5 change according to heating and cooling loads, the displacement of the hot displacer 3 is detected by the displacement sensor 61 on the hot cylinder side and the displacement of the cold displacer 5 is detected by the displacement sensor 62 on the cold cylinder side, so that, in the event of an excess stroke, it is concluded that there is a possibility of collision of the displacers 3 and 5 against the cylinders 2 and 4 respectively is detected, and in the event of too short stroke, it is concluded that there is a possibility of stopping of the displacers 3 and 5 is also detected, Therefore the strokes of the displacers 3 and 5 can be kept within a proper range at all times by controlling the quantity of heat supplied to the working gas in the hot working space 2*a* in accordance with the result of the operation by the control device 63.

Therefore, the displacers 3 and 5 can continue operating in a stable condition of operation at all times without colliding against the cylinders 2 and 4 or stopping even when the heating and cooling loads are changed.

In the present embodiment, the displacer stroke is properly controlled by changing the quantity of heat supplied to the working gas, on the basis of the positional information of the displacers 3 and 5. The strokes of the displacers 3 and 4 can be controlled on the basis of the positional information of the displacers 3 and 5 by use of the driving motor control devices shown in FIG. 8 even when the outputs of the driving motors 52 and 55 are controlled with the frequency being kept in the vicinity of the resonance frequency of the driving system, thereby providing the same advantage as the first embodiment.

Figure 13:
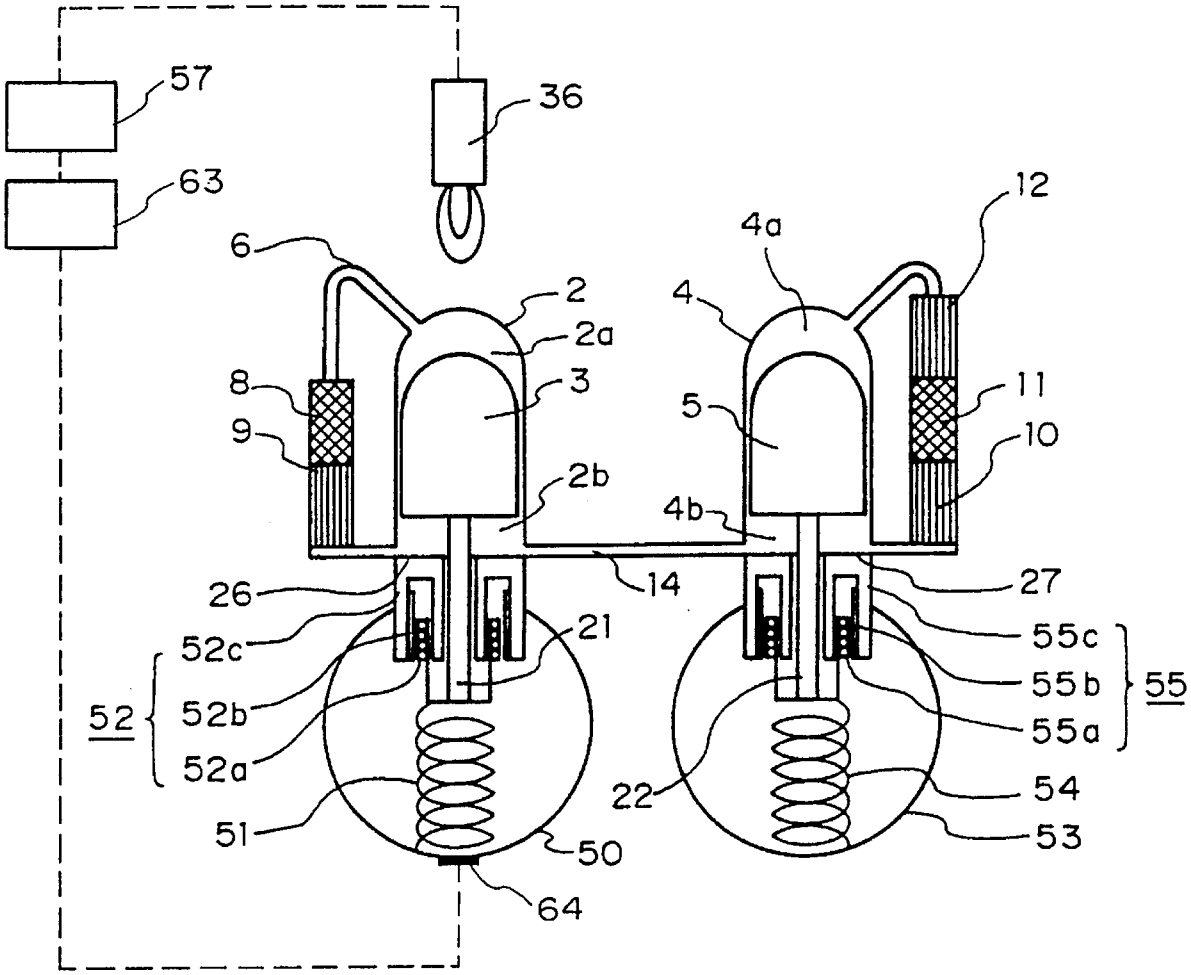
FIG. 13 is a sectional view showing the constitution of a free-piston Vuilleumier heat pump according to another embodiment of the present invention.

FIG. 13 is a sectional view showing the constitution of a free-piston Vuilleumier heat pump according to another embodiment of the present invention. In this drawing, reference numeral 64 is a vibration detecting element such as an acceleration sensor mounted on a stationary part of the hot cylinder 2 or the cold cylinder 4 of the free-piston Vuilleumier heat pump, for example, the high-temperature spring case 50.

Next, operation will be explained. When the strokes of the hot displacer 3 and cold displacer 5 are increased in accordance with the heating and cooling loads, a collision of the displacer against the cylinder with the vibration detecting element is detected by the vibration detecting element 64 and the quantity of heat supplied to the working gas in the hot working space 2*a* is controlled to decrease, on the basis of a result of operation by the arithmetic circuit 63, thus constantly keeping the strokes of the displacers 3 and 5 within a proper range.

Accordingly, the heat pump can be operated under a stable condition of operation without continuously collisions of the displacers 3 and 5 against the cylinders 2 and 4 even when a change is made in heating and cooling loads.

Since the vibration detecting element 64 is capable of detecting collision when mounted on other stationary part, such as the low-temperature spring case 53, hot cylinder 2, and cold cylinder 4, beside the high-temperature spring case 50, the same advantage is obtainable. Furthermore, there is such an advantage that the vibration detecting element 64 can be mounted easily as compared with the displacement sensors 61 and 62 explained in FIG. 12.

In the present embodiment, the displacer strokes are controlled within a proper range by decreasing, the quantity of heat supplied to the working gas on the basis of a vibration information. Alternately, it is possible to control the strokes of the displacers 3 and 5 the outputs of the driving motors 52 and 55 with the frequency held near the resonance frequency of the driving system in accordance with the vibration information, thereby providing the advantage mentioned above.

In the above-described embodiment, the driving motors 52 and 55 are provided for both of the driving system of the hot displacer 3 and the driving system of the cold displacer 5; however, either one or both of the driving motors 52 and 55 may be dispensed with if the displacers can start. This is applicable to all of the embodiments, providing the same advantageous effect as the embodiment, except when the driving motors are used for stroke control.

Figure 14:
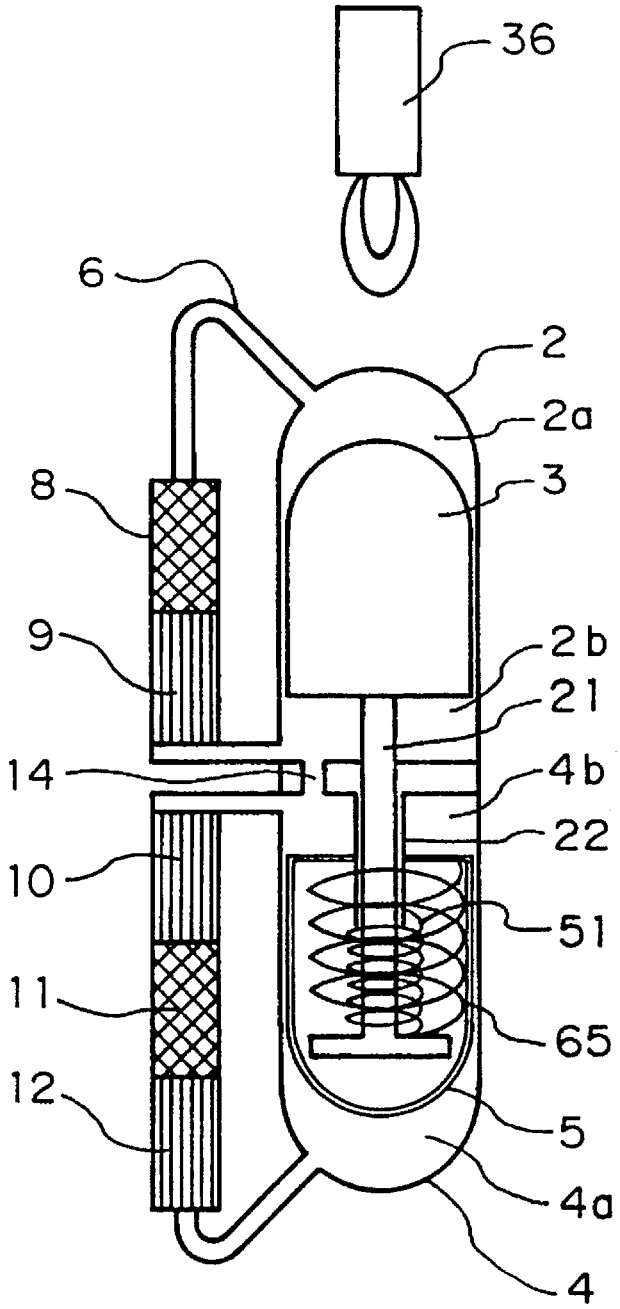
FIG. 14 is a sectional view showing the constitution of a major portion of a free-piston Vuilleumier heat pump according to another embodiment of the present invention.
Figure 15:
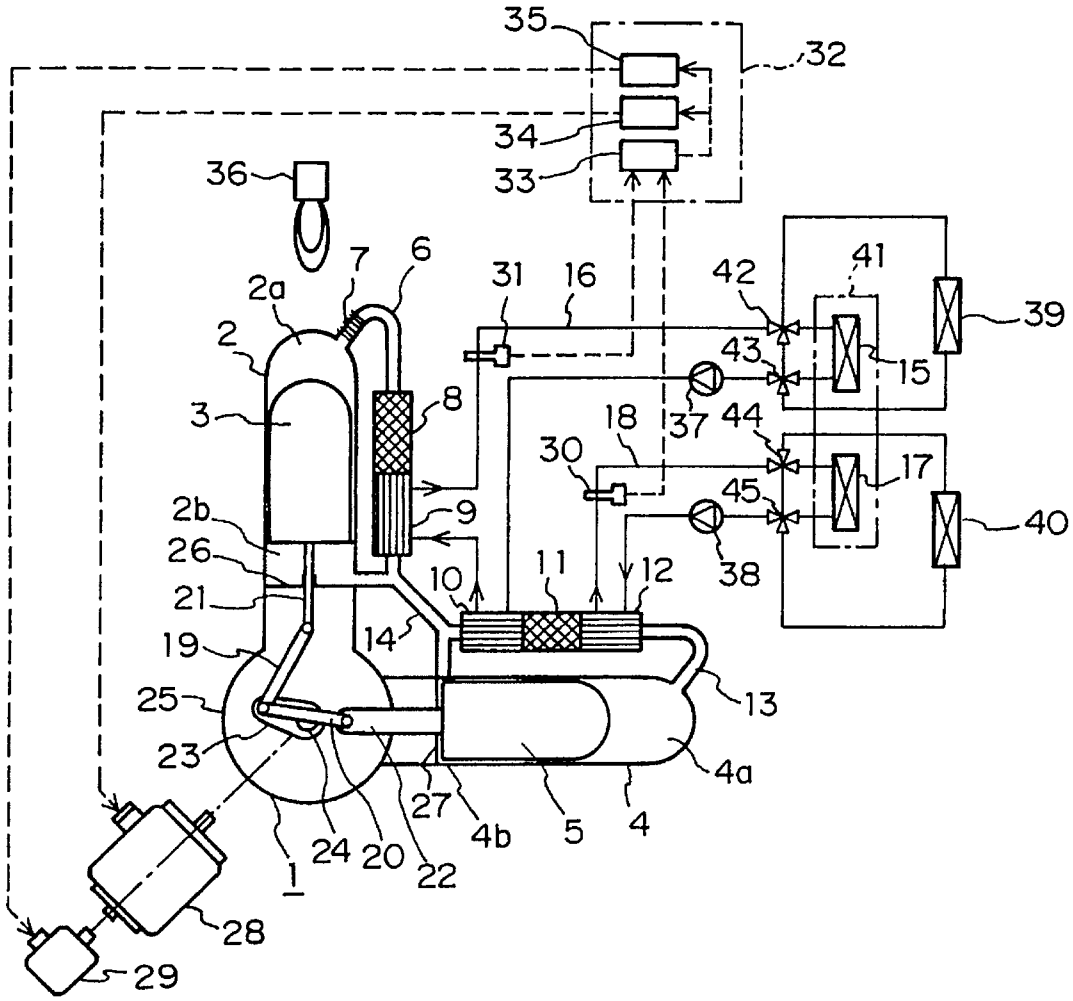
FIG. 15 (PRIOR ART)
FIG. 15 is a sectional view showing the constitution of one example of a prior art Vuilleumier heat pump.
Figure 16:
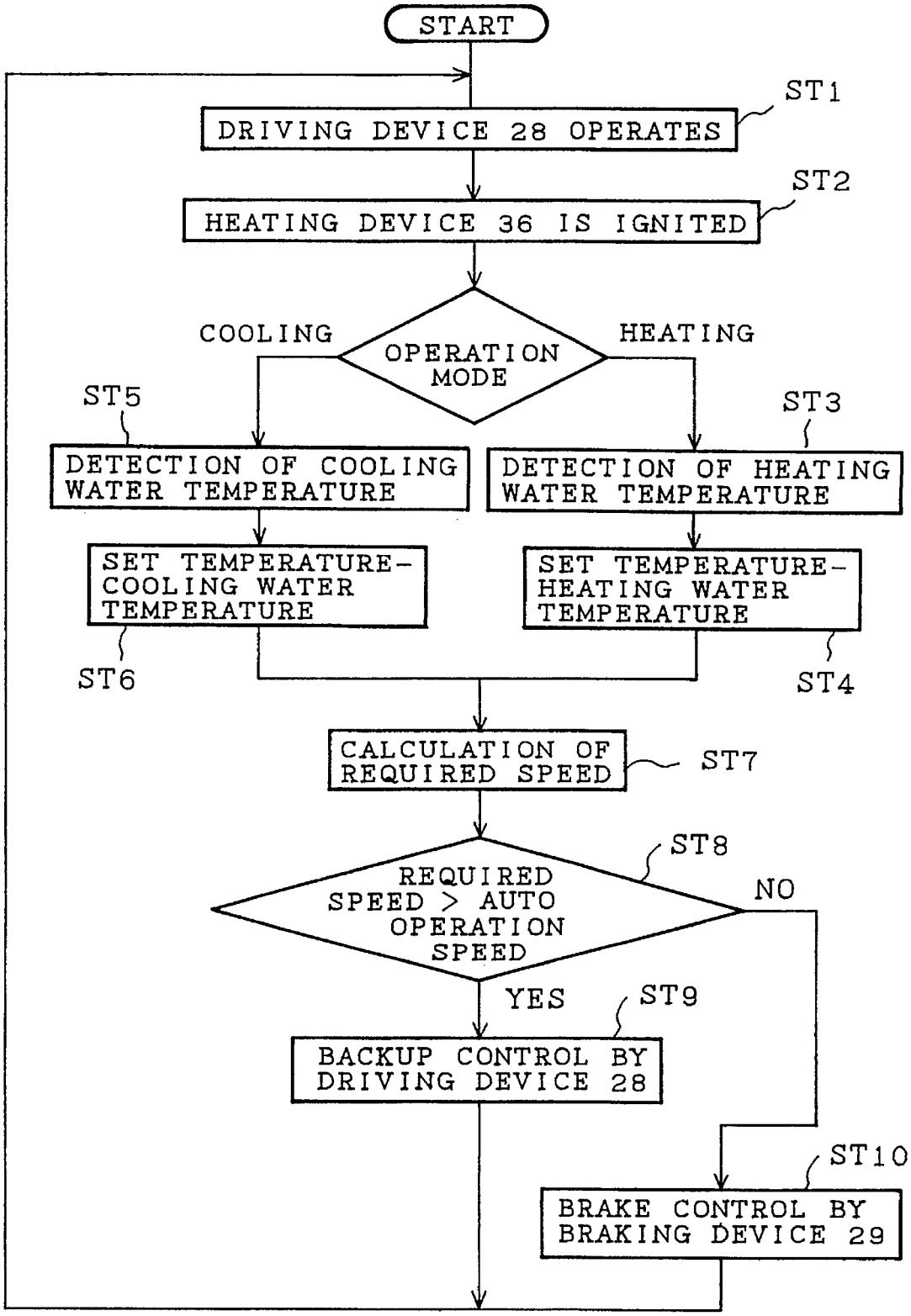
FIG. 16 (PRIOR ART)
FIG. 16 is a flowchart showing the output control processing of the Vuilleumier heat pump shown in FIG. 15.

Furthermore, in the Vuilleumier heat pump of such the constitution illustrated in FIG. 14 that the hot displacer 3 and cold displacer 5 are arranged in one row, and for example a connecting spring 65 is newly provided in place of the coil spring on the cold cylinder side omitted, the heating energy and cooling energy producing mechanism is the same as that stated in each of the above-described embodiments and the above-described constitution is applicable to all of these embodiments, offering the same advantageous effect as the above-described embodiments.

In the above-described embodiments, the free-piston Vuilleumier heat pump used chiefly in heating and cooling air conditioning has been explained; it, however, should be noticed that the present invention is not limited thereto and is applicable for example to refrigeration in which the same advantageous effect as the above described embodiments can be obtained.

As described above, the present invention has many advantages explained below.

According to the free-piston Vuilleumier heat pump of the present invention, the heating energy and cooling energy outputs are controlled by controlling the hot and cold displacer strokes to thereby enable to easily and stably increase and decrease the heating energy and cooling energy outputs. In the event of a load change, the heat pump is constantly operable in the vicinity of the resonance frequency while keeping a high coefficient of performance.

The strokes of the hot displacer and cold displacer are controlled through the control of the working gas temperature in the hot working space. This enables easily changing the heating energy and cooling energy outputs and further ensures a high coefficient of performance under a stabilized operating condition without giving almost any effect to the coefficient of performance.

The working gas temperature in the hot working space is controlled by controlling the quantity of the heat supplied to working gas in the hot working space, thereby enabling constantly stable and proper control of the working gas temperature in the hot working space and accordingly ensuring stabilized operation of the whole body of the equipment with a high coefficient of performance.

There is provided a motor for at least one of the hot displacer and cold displacer for the purpose of controlling the motor output while maintaining the motor operation frequency near the resonance frequency which is determined by the driving system of the hot displacer and the cold displacer, in place of controlling the working gas temperature in the hot working space; it is, therefore, easy to change the heating energy and cooling energy outputs and furthermore to obtain a stable operating condition and to maintain a high coefficient of performance.

There is provided a temperature detecting device on at least one of the heating load side and cooling load side for the purpose of controlling the heating energy or cooling energy output in accordance with a temperature information fed from the temperature detecting device, thereby enabling to supply proper heat to the load at all times.

There is provided a detecting device for detecting the position of at least one of hot displacer and cold displacer in reciprocating motion of these displacers, so that the heating energy and cooling energy outputs may be controlled on the basis of information including a positional information obtained from the detecting device and a temperature information obtained from the temperature detecting device. Thus it is possible to control the displacer stroke while preventing collisions of the top and bottom ends of the displacers against the cylinders with a rise of the working gas temperature in the hot working space and avoiding a stopping of displacer motion likely to be caused by a lowering of the working gas temperature in the hot working space. Thus the heat pump can constantly operate under a stable condition at all times while preventing breakage resulting from collision and burning resulting from stopping.

The free-piston Vuilleumier heat pump is provided with a vibration detecting mechanism in a stationary part to control the heating energy and cooling energy outputs in accordance with information including a piece of information given by the vibration detecting mechanism and a temperature information obtained from the temperature detecting mechanism. Therefore, it is possible to obtain operation stability without continuation of collisions of the top and bottom ends of the displacers against the cylinders at the time of a rise of the working gas temperature in the hot working space, and to prevent breakage likely to be caused by collision.

Although referred embodiments of the present invention have been illustrated and described herein it will be understood that the present invention is not limited thereto and various modifications and adaptations are possible within the spirit and scope of the present invention.

What is claimed is:

1. A free-piston Vuilleumier heat pump having a hot displacer which constitutes a resonance system inclusive of a spring and reciprocates in a hot cylinder over a distance corresponding to a stroke displacement of the hot cylinder and a cold displacer which constitutes a resonance system inclusive of a spring and reciprocates in a cold cylinder over a distance corresponding to a stroke displacement of the cold cylinder, a hot working space and a moderate temperature working space on a hot cylinder side in said hot cylinder which are separated by said hot displacer being connected by way of a hot heat exchanger, a regenerator on a hot cylinder side, and a moderate temperature heat exchanger on the hot cylinder side, and a cold working space and a moderate temperature working space on a cold cylinder side in said cold cylinder which are separated by said cold displacer being connected by way of a cold heat exchanger, a regenerator on a cold cylinder side, and a moderate temperature heat exchanger on the cold cylinder side;

said moderate temperature working space on the hot cylinder side being connected with said moderate temperature working space on the cold cylinder side; and energy for heating being obtained from said moderate temperature heat exchanger on the hot cylinder side and said moderate temperature heat exchanger on the cold cylinder side and energy for cooling being obtained from said cold heat exchanger, said free-piston Vuilleumier heat pump comprising:

a control means for controlling the stroke displacement of said hot displacer and for controlling the stroke displacement of said cold displacer for the purpose of controlling heating energy and cooling energy outputs.

2. The free-piston Vuilleumier heat pump as claimed in claim 1, wherein said control means controls the stroke displacement of said hot displacer and said cold displacer by controlling a working gas temperature in said hot working space in said hot cylinder.

3. The free-piston Vuilleumier heat pump as claimed in claim 2, wherein said control means control a quantity of heat supplied to said working gas in said hot working space in said hot cylinder, thereby controlling said working gas temperature in said hot working space.

4. The free-piston Vuilleumier heat pump as claimed in claim 1, wherein said control means controls the stroke displacement of said hot displacer and said cold displacer by controlling output of a motor which gives a driving force to at least one of said hot displacer and said cold displacer while keeping an operation frequency of said motor at approximately a resonance frequency determined by driving systems of said hot displacer and said cold displacer.

5. The free-piston Vuilleumier heat pump as claimed in any one of claims 1 to 4, wherein said heat pump further comprises a temperature detecting means for detecting a temperature of at least either one of said moderate temperature heat exchanger on said hot cylinder side and said moderate temperature heat exchanger on said cold cylinder side; and wherein said control means controls the heating energy and cooling energy outputs on the basis of a temperature information fed from said temperature detecting means.

6. The free-piston Vuilleumier heat pump as claimed in claim 5, wherein said heat pump further comprises a detecting means for detecting a position of at least one part of said hot displacer and said cold displacer in the reciprocating motion of said displacers, and wherein said control means controls the heating energy and cooling energy outputs on the basis of a positional information fed from said detecting means and a temperature information fed from said temperature detecting means.

7. The free-piston Vuilleumier heat pump as claimed in claim 5, wherein said heat pump further comprises a vibration detecting means mounted in a stationary part of either one of said hot cylinder and said cold cylinder, and wherein said control means controls the heating energy and cooling energy outputs on the basis of information fed from said vibration detecting means and on the basis of temperature information fed from said temperature detecting means.

* * * * *